US007025011B2

(12) United States Patent
Jordan et al.

(10) Patent No.: US 7,025,011 B2
(45) Date of Patent: Apr. 11, 2006

(54) APPARATUS FOR AUTOMATICALLY ORIENTING HOSIERY ARTICLES FOR CLOSING TOE ENDS THEREOF

(75) Inventors: Bob Jordan, Burlington, NC (US); Michael R. Wood, Burlington, NC (US)

(73) Assignee: B.B. & S Knitting Consultants, Burlington, NC (US)

( * ) Notice: Subject to any disclaimer, the term of this patent is extended or adjusted under 35 U.S.C. 154(b) by 121 days.

(21) Appl. No.: 10/351,747

(22) Filed: Jan. 24, 2003

(65) Prior Publication Data

US 2004/0155074 A1 Aug. 12, 2004

(51) Int. Cl.
*D05B 21/00* (2006.01)

(52) U.S. Cl. ..... 112/470.8; 112/475.12

(58) Field of Classification Search ..... 112/470.08, 112/470.15, 475.03, 475.12, 475.04; 66/215, 66/187, 9 R; 223/112, 1, 43
See application file for complete search history.

(56) References Cited

U.S. PATENT DOCUMENTS 2,069,021 A 1/1937 Schuessler
2,239,346 A 4/1941 Strong
2,522,842 A 9/1950 Scholl
2,926,513 A 3/1960 Tew
2,980,917 A 4/1961 Slane
3,520,262 A 7/1970 Bolles et al.
3,601,818 A 8/1971 Chesebro et al.
3,626,727 A 12/1971 Wood et al.
3,721,111 A 3/1973 Billi
3,800,559 A 4/1974 Fecker
3,800,563 A 4/1974 Billi
3,941,069 A 3/1976 Fukuyama
4,014,186 A 3/1977 Ferraguti
4,037,436 A 7/1977 Wehrmann
4,047,401 A 9/1977 Nurk
4,055,201 A 10/1977 Fowler et al.
4,192,242 A 3/1980 Haselgrove et al.
4,364,320 A 12/1982 Nakhle et al.
4,383,490 A 5/1983 Hodges (Continued)

*Primary Examiner*—John J. Calvert
*Assistant Examiner*—Brian Kauffman
(74) *Attorney, Agent, or Firm*—Alston & Bird LLP

(57) ABSTRACT

An apparatus for orienting sock blanks or the like so that the open toes of the blanks can be sewn closed includes a device for turning the sock inside out, a sock rotation device for grasping the sock and rotating it until sensors detect that the sock is in the proper orientation, a sock transfer device for taking the sock from the sock rotation device toward a sewing machine, and sock guiding and positioning mechanisms for feeding the sock into the in-feed nip of the sewing machine.

25 Claims, 15 Drawing Sheets

U.S. PATENT DOCUMENTS

| | | | | |
|---|---|---|---|---|
| 4,383,491 | A | | 5/1983 | Hodges |
| 4,444,140 | A | | 4/1984 | Moyer |
| 4,550,710 | A | | 11/1985 | McDonald, II |
| 4,602,419 | A | | 7/1986 | Harrison et al. |
| 4,609,419 | A | | 9/1986 | Hodges |
| 4,958,507 | A | | 9/1990 | Allaire et al. |
| 5,014,634 | A | | 5/1991 | Hodges et al. |
| 5,040,475 | A | | 8/1991 | Fournier et al. |
| 5,165,355 | A | | 11/1992 | Fournier et al. |
| 5,398,626 | A | | 3/1995 | Rosso et al. |
| 5,531,173 | A | | 7/1996 | Migliorini |
| 5,651,483 | A | | 7/1997 | Bell et al. |
| 5,771,830 | A | | 6/1998 | Hodges |
| 5,899,159 | A | * | 5/1999 | Dasher et al. ..... 112/475.03 |
| 5,904,279 | A | | 5/1999 | Bertram et al. |
| 6,003,345 | A | | 12/1999 | Jordan |
| 6,158,367 | A | | 12/2000 | Jordan et al. |

* cited by examiner

APPARATUS FOR AUTOMATICALLY ORIENTING HOSIERY ARTICLES FOR CLOSING TOE ENDS THEREOF

FIELD OF THE INVENTION

The invention relates to the manufacture of articles of hosiery. The invention relates more particularly to methods and apparatus for handling articles of hosiery having open toe ends that are to be closed in a sewing machine, and most particularly to methods and apparatus for automatically orienting the open toe ends of half-hose or socks and positioning them for feeding into an automatic sewing machine.

BACKGROUND OF THE INVENTION

A variety of hosiery articles are formed on circular knitting machinery, coming off the machinery in the form of generally tubular articles. The toe portions of the articles typically are not closed on the circular knitting machine. Instead, the articles are taken off the knitting machine with open toe ends that are subsequently closed by sewing in a sewing machine. In many cases, a shaped heel portion may be knit into the article. Particularly in the case of hosiery with a shaped heel, it is desirable for the seam closing the toe end to be made in a predetermined orientation relative to the heel.

In the case of socks, often the socks are knit to have a shaped toe portion that curves upward from the sole portion toward the instep portion of the sock, and the seam across the toe end desirably is positioned such that it is above, or at least is not below, the toes of the wearer. The term "socks" hereinafter will be used to refer to hosiery articles that do not extend above the knee of the wearer when in the fully extended position of normal use, and which are knit from relatively coarse yams. Included in the category of "socks" are crew socks, mid-calf socks, knee-high socks, sports socks, and the like. Such socks are typically knit with less than about 700 stitches per square inch. In socks having shaped toe portions and/or shaped heel portions, it is desirable for the seam closing the toe end to extend generally across the toes. To achieve this result, it is necessary for the open-toe sock blanks to be fed into the toe-closing sewing machine in a particular orientation.

The process of feeding open-toe sock blanks into toe-closing sewing machines has been performed manually in many manufacturing plants. In other cases, an automated device for feeding the blanks into the sewing machine has been used, but in all of the known devices in widespread commercial use it has still been necessary for a human attendant to orient the blanks properly on the feeding device. The need for manual intervention by human attendants is obviously undesirable from the standpoint of productivity and efficiency of the manufacturing operation.

In the manufacture of women's nylon hose and the like, efforts have been made to automate the entire process of properly orienting the open-toe hose blanks and feeding the oriented blanks into the sewing machine. For example, Detexomat Machinery Limited of the United Kingdom has developed machines that orient nylon hose blanks and feed them into a seamer. An example of such a machine is described in U.S. Pat. No. 4,383,491. The machine is a rotary device having ten tubular carriers on which hose blanks are sleeved. The tubular carriers are mounted on a rotary turret, which rotates to transport each carrier to each of ten stations arranged about the periphery of the turret.

Each carrier includes a pair of reciprocally movable finger blades that extend radially outward from diametrically opposite sides of the tubular carrier. At a first station, an operator loads a hose blank onto the carrier disposed at the first station so that the hose blank is sleeved over the tubular carrier and the finger blades. The turret then rotates to transport the hose blank to the second station having a wind-on roller that engages the hose blank and is driven to draw the blank fully onto the carrier, the roller being disengaged from the blank when a photo-sensor detects the toe end of the blank on the carrier. The hose blank is then advanced to the third station having a positioner that longitudinally positions the toe end of the blank on the carrier with the aid of a photo-sensor that detects when a discernable feature of the toe end becomes longitudinally aligned with the photo-sensor. The blank is then advanced to the fourth station, where the blank is positioned rotationally so that the toe end is in a predetermined orientation relative to a clamp means that will later clamp the toe end for seaming the toe end. The rotational position of the blank is controlled by a positioning means that frictionally engages the blank on the tubular carrier and rotates the blank about the carrier and the finger blades. Various positioning means that are moved into and out of engagement with one side of the hose blank are disclosed, including a padded roller driven about an axis parallel to the axis of the tubular carrier, a driven belt looped about a pair of rollers, and a bar that is driven tangentially relative to the tubular carrier. The positioning means is disengaged from the blank when a photo-sensor detects an indicating mark on the hose blank. The patent states that the indicating mark can be knitted into the hose using a contrasting thread. The machine includes a seamer at another station for closing the toe ends of the hose blanks.

The machine described in the '491 patent is a relatively complicated and expensive piece of equipment, and yet still requires a human attendant to load hose blanks onto the carriers. The machine is intended to be a replacement for a separate sewing machine, but likely would cost considerably more than a simple sewing machine that is dedicated to closing toe ends of hosiery articles. Moreover, the finger blades used for spreading the hose blanks for seaming may allow a relative smooth-knit fabric such as nylon hose to freely rotate about them when orienting the blanks, but with a coarser-knit fabric such as typically used in socks it is anticipated that the finger blades may not allow free rotation of the sock blanks. The roller, belt, or bar used for rotating the hose blanks about the tubular carriers and finger blades engages only a small fraction of the circumference of the blanks; accordingly, if there is any resistance of the blank to rotation about the carrier and finger blades, it is expected that the blank would stretch and deform, thereby compromising the accuracy with which the blank can be rotationally positioned for seaming.

What is needed is an automated apparatus and method for orienting the open toe ends of socks for sewing in a sewing machine. Preferably, the apparatus and method should be readily adaptable for use with existing sewing machines.

The assignee of the present application has developed such an apparatus and method, which are described in U.S. Pat. No. 6,158,367, the entire disclosure of which is incorporated herein by reference. The apparatus of the '367 patent represented a vast improvement over the conventional process of manually orienting and feeding socks to a sewing machine. Further improvements in the apparatus and method continue to be sought, however, and the present invention has resulted from such efforts.

SUMMARY OF THE INVENTION

The present invention addresses the above needs and achieves other advantages, by providing an apparatus that includes a unique sock rotation device for grasping and rotating a sock in a controlled fashion, and a sensor system employing one or more optical sensors (e.g., laser or infrared sensors) that detect predetermined features at the toe end of the sock as it is rotated by the sock rotation device so as to determine when the sock is in the desired rotational orientation for feeding to a sewing machine.

In a preferred embodiment of the invention, the sock rotation device includes a pair of rotatably driven rods that are inserted into the open toe end of the sock and are spread apart to grasp the sock and flatten it. The rods are then driven to cause the sock to rotate on the rods, similar to an endless belt rotating about a pair of drive pulleys or sprockets. As the sock rotates, the optical sensors look for certain features on the toe end to determine what orientation the sock is in. More particularly, in the preferred embodiment, one of the sensors looks for the curved edge of an axially protruding toe pocket of the sock, and another sensor looks for an increased height of the toe portion indicative of the bulkiness of the toe pocket. These sensors work in harmony to detect when the toe pocket of the sock in located in a predetermined position relative to the rods, and specifically when the toe pocket is substantially centered between the rods and facing in a predetermined direction (e.g., upward in the case of the rods being horizontally oriented).

The sensor system in a preferred embodiment further includes a third optical sensor whose light beam is aimed to detect the edge of the toe opening. The sock rotation device preferably is operable to adjust the axial positioning of the sock in response to the output signal of the third sensor so as to maintain the sock in a predetermined axial position suitable for proper detection of the toe pocket by the other sensors.

The apparatus in the preferred embodiment further comprises a sock transfer device for taking the sock off the sock rotation device once the sock is in the desired rotational orientation, and transferring the sock into an in-feed nip of a sewing machine. Preferably, the sock transfer device comprises a pair of spreader fingers arranged substantially in a plane inclined about 45° relative to horizontal, the sock transfer device being operable to spread the spreader fingers apart to grasp the sock and maintain the toe end of the sock in a substantially flattened condition, and to transfer the sock toward an in-feed nip of a sewing machine while maintaining the spreader fingers inclined about 45° from horizontal, whereby the sock can be fed into either a vertically arranged in-feed nip or a horizontally arranged in-feed nip.

BRIEF DESCRIPTION OF THE DRAWINGS

The above and other objects, features, and advantages of the invention will become more apparent from the following description of certain preferred embodiments thereof, when taken in conjunction with the accompanying drawings in which:

FIG. 28 is an end elevation showing the sock transfer device carrying the sock blank toward the sewing machine;

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1A:
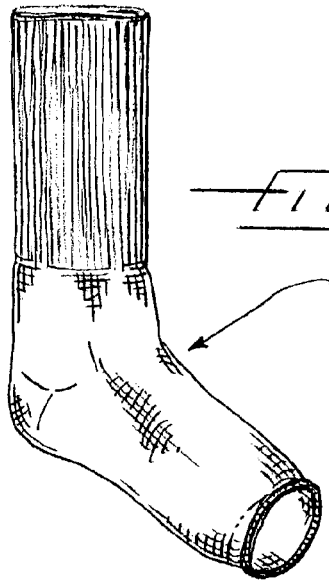
FIG. 1A is a perspective view of a sock blank.
Figure 1B:
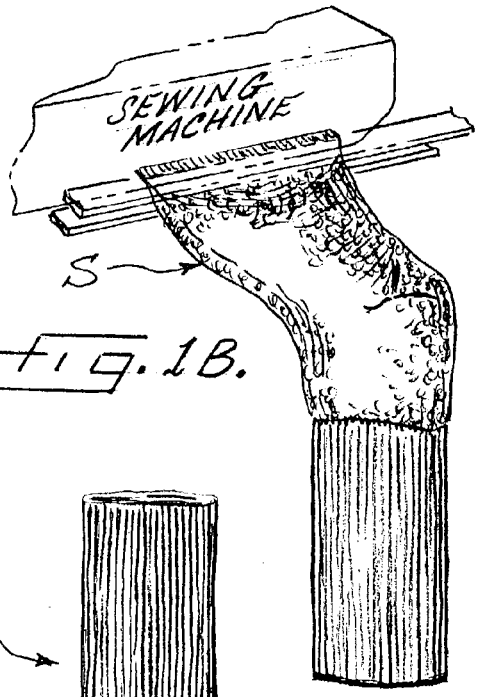
FIG. 1B is a perspective view showing the sock blank fed into a sewing machine for closing the open toe end of the blank.
Figure 1C:
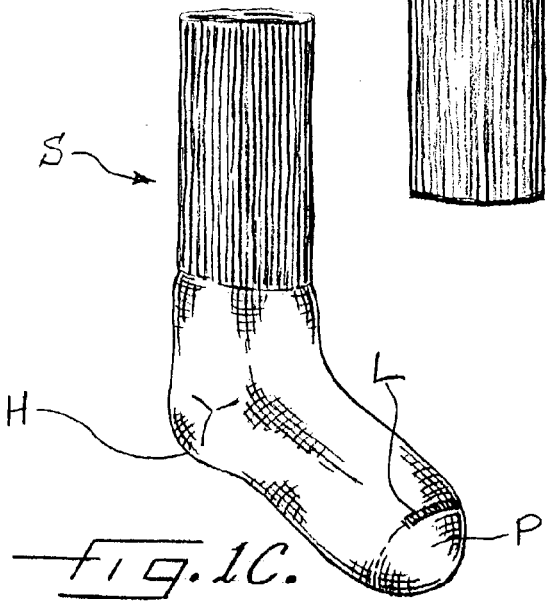
FIG. 1C is a perspective view of the finished sock.

The present invention relates to an apparatus for properly orienting a sock blank, such as the sock blank S shown in FIG. 1A, so that the open toe end of the blank can be sewn closed in a sewing machine, as illustrated in FIG. 1B. The type of sock to which the invention relates in particular is one having a shaped heel portion H and an extended toe pocket P (FIG. 1C) that extends beneath the toes and up around the ends of the toes and is sewn along a stitch line L that extends over the tops of the toes when worn. It is important in closing the toe of this type of sock that the stitch line be properly oriented relative to the shaped heel portion H, or else the stitch line will not lie over the toes as desired, and the toe region will not have the desired shape conforming to the foot.

Conventionally, sock blanks of this type are manually oriented and fed into a sewing machine by a worker. The invention aims to automate the process. An apparatus for automatically orienting and feeding the sock blanks into a sewing machine is shown in FIGS. 2 through 30.

Figure 3:
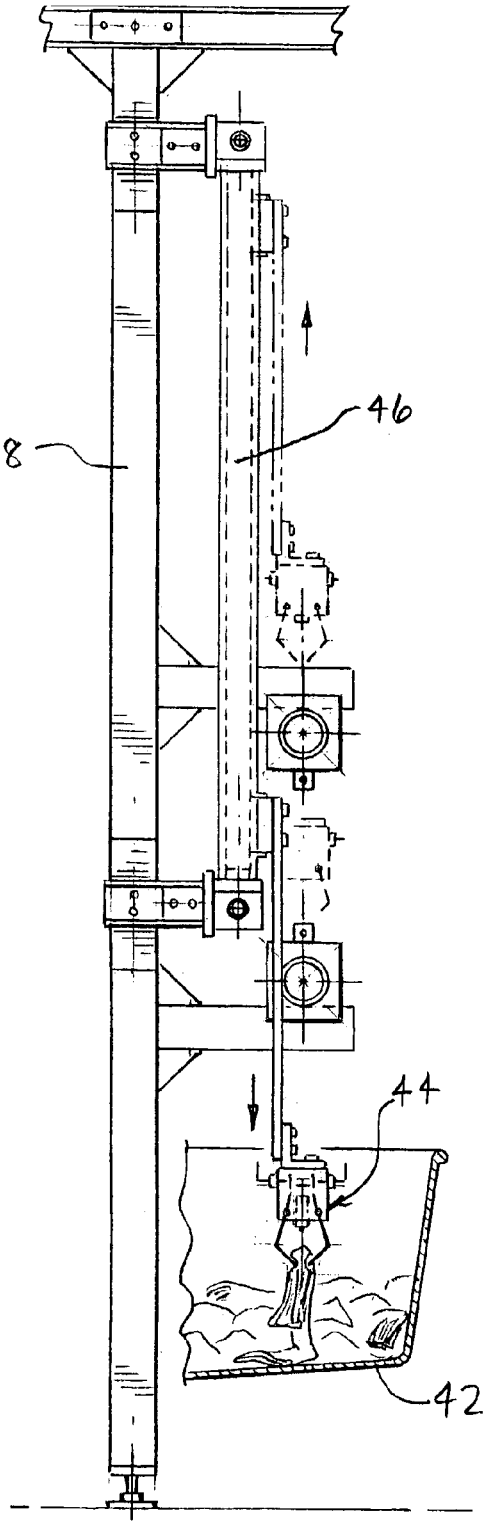
FIG. 3 is a view of the sock pick-up portion along line 3—3 in FIG. 2.
Figures 2, 4:
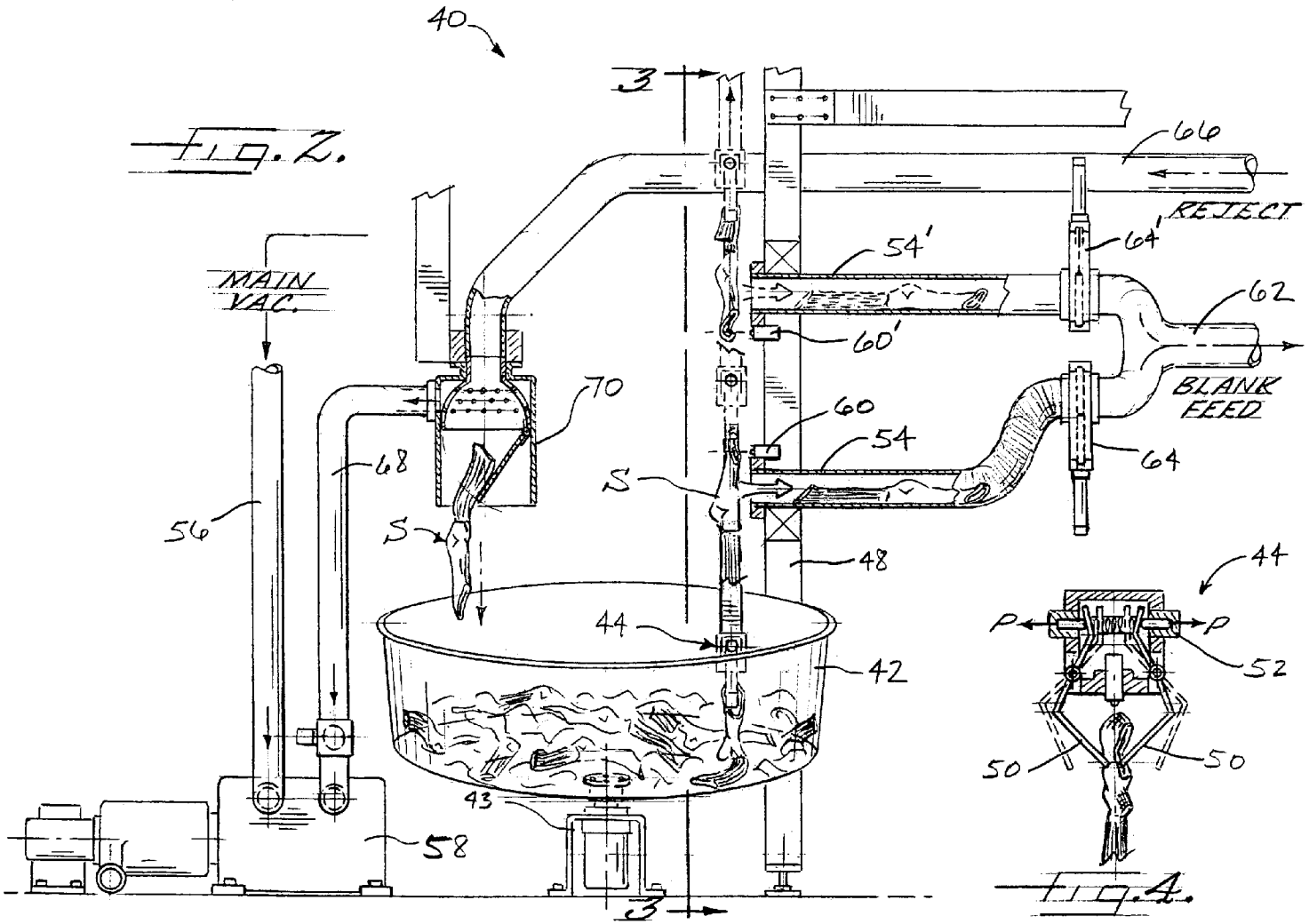
FIG. 2 is an elevation, partly in section, of a sock pick-up portion of an apparatus in accordance with a preferred embodiment of the invention.
FIG. 4 is a detail view of a sock pick-up mechanism.

With reference to FIG. 2, the apparatus includes a sock pick-up system 40 for picking up sock blanks one at a time from a hopper 42 containing a plurality of blanks and feeding the blanks sequentially to the next system of the apparatus. The hopper 42 preferably is rotatable by a suitable rotating mechanism 43. The pick-up system 40 includes a pick-up mechanism 44, shown in isolation in FIG. 4, mounted for vertical movement by means of a rodless cylinder 46 or other linear actuator or motor. The cylinder 46 is affixed to a vertical frame 48. The pick-up mechanism 44 can be any suitable mechanism operable to grasp a sock blank when remotely commanded to do so. An exemplary pick-up mechanism is shown in FIG. 3 as comprising a pair of opposed gripping fingers 50 mounted for movement toward and away from each other to form a pincers. The gripping fingers 50 are spring-biased together to grasp a sock, and a pair of air cylinders 52 or the like urge the fingers apart to release the sock. The invention of course is not limited to any particular type of pick-up mechanism.

The cylinder 46 is arranged to lower the pick-up mechanism 44 into the hopper 42 so that the pick-up mechanism can be operated to grasp a sock blank. The cylinder 46 then raises the pick-up mechanism upward as shown in phantom lines in FIG. 2 and FIG. 3. As the sock blank is vertically raised, it passes by the open end of a first vacuum transfer tube 54 that extends generally horizontally. The vacuum transfer tube 54 is connected to a main vacuum line 56 that is coupled to a source of vacuum 58. A first optical sensor 60 is arranged in proximity to the open end of the first vacuum transfer tube 54 for detecting the toe end of the sock. For instance, the toe end of the sock may have a special colored thread knit into it that the sensor 54 is sensitive to. When the sensor 60 detects the toe end of the sock, the pick-up mechanism 44 is commanded to let go of the sock blank, and the sock blank is sucked, toe end first, into the first vacuum transfer tube 54.

The pick-up system preferably also includes a second vacuum transfer tube 54' having an associated optical sensor 60' located at a higher vertical height than the first transfer tube and sensor. The two transfer tubes 54, 54' commonly feed into a main transfer tube 62 that is connected to the source of vacuum; remotely controllable gates 64, 64' are respectively provided in the transfer tubes 54, 54' for selectively closing the tubes so that a sock can be sucked from a selected one of the tubes into the main transfer tube 62. As further described below, the apparatus also includes a reject tube 66 connected to the vacuum source 58 by a line 68. The reject tube 66 leads to a reject flapper valve device 70 disposed above the hopper 42. A rejected sock blank is drawn through the reject tube 66 into the flapper valve device 70, and then vacuum is discontinued in the line 68 so that the flapper valve device drops the rejected sock blank into the hopper.

Provision of the dual vacuum transfer tubes 54, 54' allows increased throughput and also provides some measure of failure elimination. More particularly, it is possible that a sock blank may be picked up by the pick-up mechanism 44 in a position or orientation in which the first sensor 54 may not be capable of reliably detecting the toe end of the sock blank. For instance, where a colored thread is knit into the toe end for detection, the sock blank may have been grabbed in its middle and may be folded in such a configuration that one portion of the blank blocks the colored thread from the first sensor's view. The second sensor 54' can be oriented to look at the sock blank from a different direction. Thus, if the first sensor happens to miss detecting the toe end, the second sensor should be able to detect it.

Figure 5:
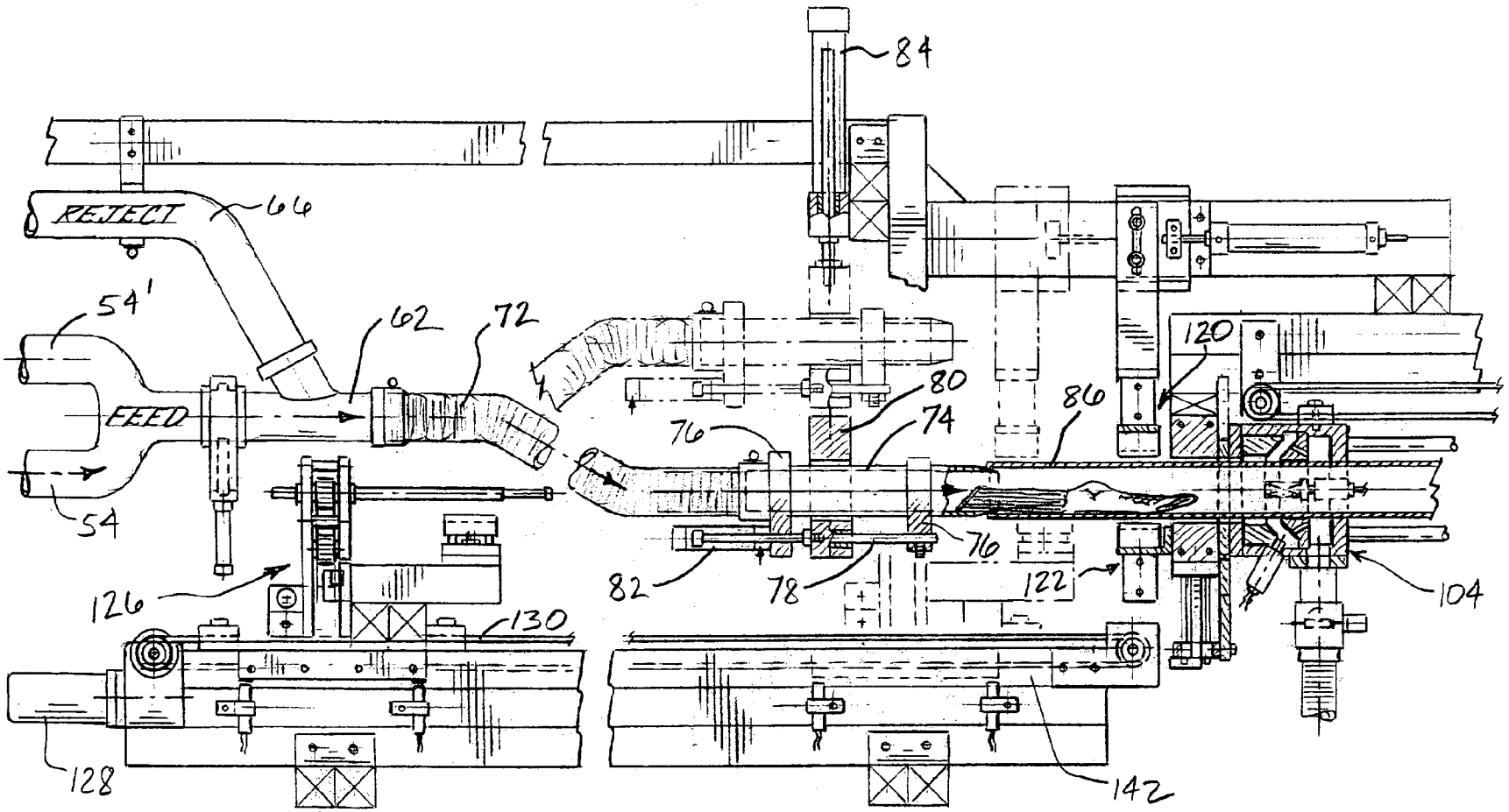
FIG. 5 is an elevation, partly in section, of a sock-inverting portion of the apparatus.

Once a sock has been sucked toe-end first into the main transfer tube 62, the sock is delivered into a flexible vacuum transfer hose 72 that is connected to a movable horizontal feed tube 74, as shown in FIG. 5. The movable feed tube 74 is supported by a pair of supports 76 spaced apart along the tube and connected together by a guide rod 78 that extends between them. The guide rod 78 extends through a guide aperture in a plate 80 such that the rod is slidable through the aperture in a horizontal direction. A pneumatic cylinder 82 or other linear actuator is affixed to the one of the supports 76 and has its cylinder rod affixed to the plate 80, which is fixed in the horizontal direction along which the cylinder rod extends and retracts. Accordingly, extension of the cylinder rod causes the supports 76, and hence the feed tube 74, to be retracted to the left in FIG. 5, and retraction of the rod moves the feed tube to the right in the figure.

The plate 80 is vertically movable by virtue of being connected to a vertically oriented cylinder 84 or the like, such that the feed tube 74 can be either raised or lowered depending on the phase of operation of the apparatus, as further explained below.

Figures 6, 7A, 7B, 8:
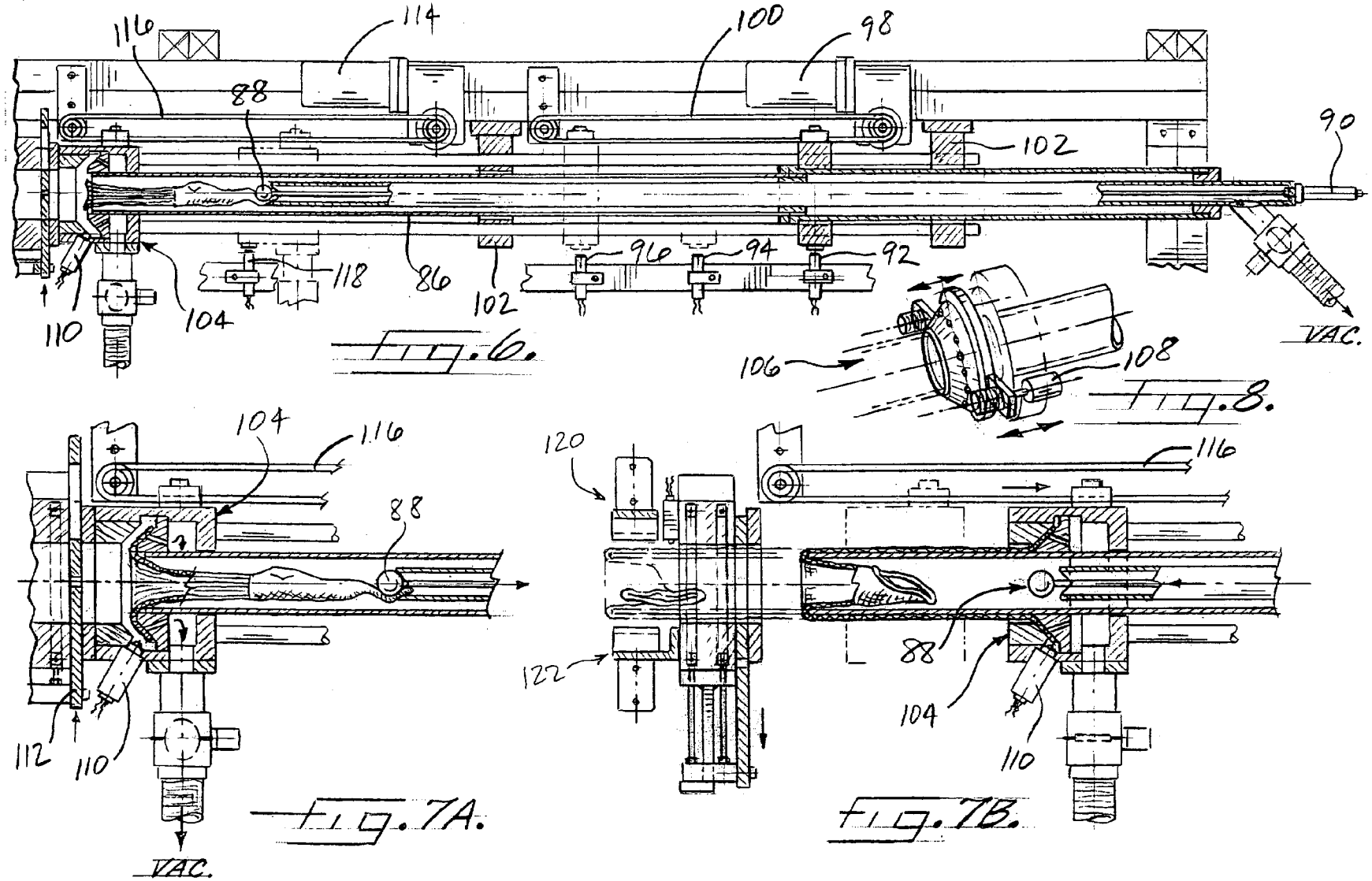
FIG. 6 is a view of a portion of the sock-inverting portion of the apparatus, showing a sock blank engaged in the sock-inverting portion in preparation for being inverted.
FIG. 7A is a view similar to FIG. 6, taken at a later instant in time when the upper end of the sock blank has been suctioned into a clamping mechanism of the sock-inverting portion.
FIG. 7B is a view at a still later time when the upper end of the sock blank has been clamped in the clamping mechanism and the clamping mechanism has been translated rearward relative to the support tube of the sock-inverting portion so as to invert the sock over the outside of the support tube.
FIG. 8 is a detail view of a part of the clamping mechanism for the upper end of the sock blank.

When the sock blank is sucked from the transfer tube 62 into the flexible hose 72 and then into the feed tube 74, the feed tube is in a position lowered and advanced to the right as shown in FIG. 5. In this position, the open end of the feed tube sealingly fits into the open end of a support tube 86 whose opposite end is connected to vacuum as shown in FIG. 6. Disposed within the support tube 86 at a location spaced from the open end thereof is a grabber device 88 for grabbing and fixing the toe end of the sock blank; the grabber device may comprise any suitable device, but is shown for purposes of the drawings as being a ball attached to a retractable and extendable rod within a tube, the rod being actuated by a pneumatic cylinder 90 or the like.

The support tube 86 is horizontally movable along its axis and can be moved into various positions depending of the phase of operation as described below. As shown in FIG. 6, three proximity sensors 92, 94, 96 are provided at axially spaced locations adjacent the support tube 86 for detecting the tube in various predetermined positions. The support tube 86 is axially translated by a motor 98 that drives a drive belt 100 affixed to the support tube. Suitable guides 102 are provided for guiding the movement of the support tube.

When the sock is fed into the support tube from the feed tube 74 as shown in FIG. 5, the support tube 86 is in its farthest advanced position (farthest to the left in FIGS. 5 and 6); the sensor 96 detects when the support tube is in this position. The grabber device 88 grabs the toe end of the sock. The support tube is then retracted to its farthest retracted position as in FIG. 6; the sensor 92 detects when the tube is in this position. In the retracted position of the support tube, the open end of the support tube is located within a vacuum clamping mechanism 104. The vacuum clamping mechanism and its function are substantially described in U.S. Pat. No. 6,158,367, which is incorporated by reference herein, and hence will not be described in detail. FIG. 8 shows an actuate-to-clamp device 106 forming a part of the clamping mechanism 104. The device 106 is actuated by pneumatic cylinders 108 or the like to clamp an upper end of the sock blank against a clamping surface within the clamping mechanism when the upper end is drawn into the clamping mechanism by vacuum. FIG. 7A shows the upper end of the sock blank having been drawn into the clamping mechanism. A pair of sensors 110 (only one visible in the drawings) detect whether the upper end of the sock has been properly drawn into the vacuum clamping mechanism; if both sensors do not see the upper end of the sock in the clamping mechanism, then the door 112 of the clamping mechanism (which when closed substantially blocks off the open end of the support tube 86) is opened and the support tube is advanced to mate with the feed tube 74, and the grabber 88 is commanded to let go of the sock. The reject vacuum system is then activated to suck the sock through the feed tube 74 into the reject tube 66 and back into the hopper. This is illustrated in FIG. 9.

However, if both of the sensors 110 see the upper end of the sock in the clamping mechanism 104, then the clamping device 106 is activated to clamp the upper end of the sock. The grabber 88 is then commanded to let go of the toe end of the sock. Next, the clamping mechanism 104, which is mounted about the support tube 86 and is axially movable by a drive motor 114 and drive belt 116, is retracted (to the right in the drawings) while the support tube remains stationary, so as to invert the sock over the outside of the support tube, as shown in FIG. 7B. The clamping mechanism 104 is retracted a distance based on the length of the sock, so that in the fully retracted position of the clamping mechanism there is still some length of the sock at the toe end remaining inside the support tube; a sensor 118 (FIG. 6) is used to detect when the clamping mechanism has been retracted to the appropriate position.

Figures 9, 10:
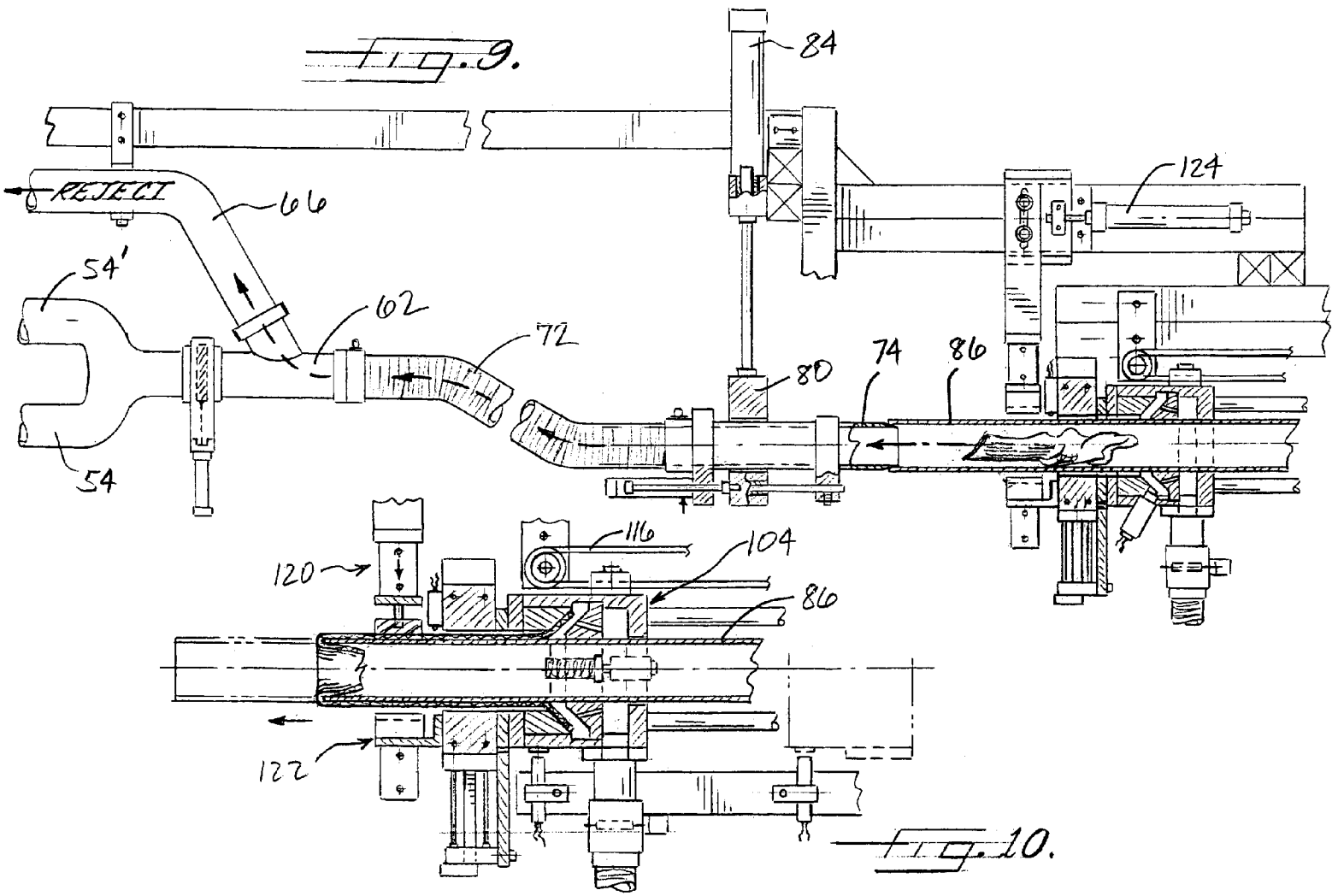
FIG. 9 is a view similar to FIG. 6, showing a sock blank being rejected when there is a failure to successfully clamp the upper end of the sock blank in the clamping mechanism.
FIG. 10 shows the sock-inverting portion at a time subsequent to that of FIG. 7B, when the sock has been inverted over the support tube and is engaged by an outer clamp to restrain the sock in axial position.

Next, the support tube 86 is advanced (to the left) to its intermediate position, as detected by the middle sensor 94, so that the open end of the support tube extends between an upper sock clamp 120 and a lower sock clamp 122, as shown in FIG. 10. The clamping mechanism 104 is also advanced to the left along with the support tube. The entire upper clamp 120 is slidably mounted on suitable guides and is axially moved by a pneumatic cylinder 124 or the like between two different positions relatively closer to and relatively farther from the clamping mechanism 104. With the upper clamp in the position closer to the clamping mechanism 104, the upper claims is activated to clamp the sock against the support tube as shown, and the clamping mechanism 104 is deactivated to let go of the upper end of the sock. Then, the support tube 86 is further advanced to its most advanced position to the left, so that substantially the entire length of the sock is sleeved over the outside of the support tube as in FIG. 11. The upper clamp 120 is then disengaged from the sock and is advanced to the left closer to the end of the support tube 86 and is reactivated to again clamp the sock on the tube. Before and during the movement of the upper clamp 120 to its position farther from the clamping mechanism 104, the lower clamp 122 is activated to clamp against the sock on the tube so that the movement of the upper clamp 120 does not inadvertently move the sock along the support tube 86.

Figure 11:
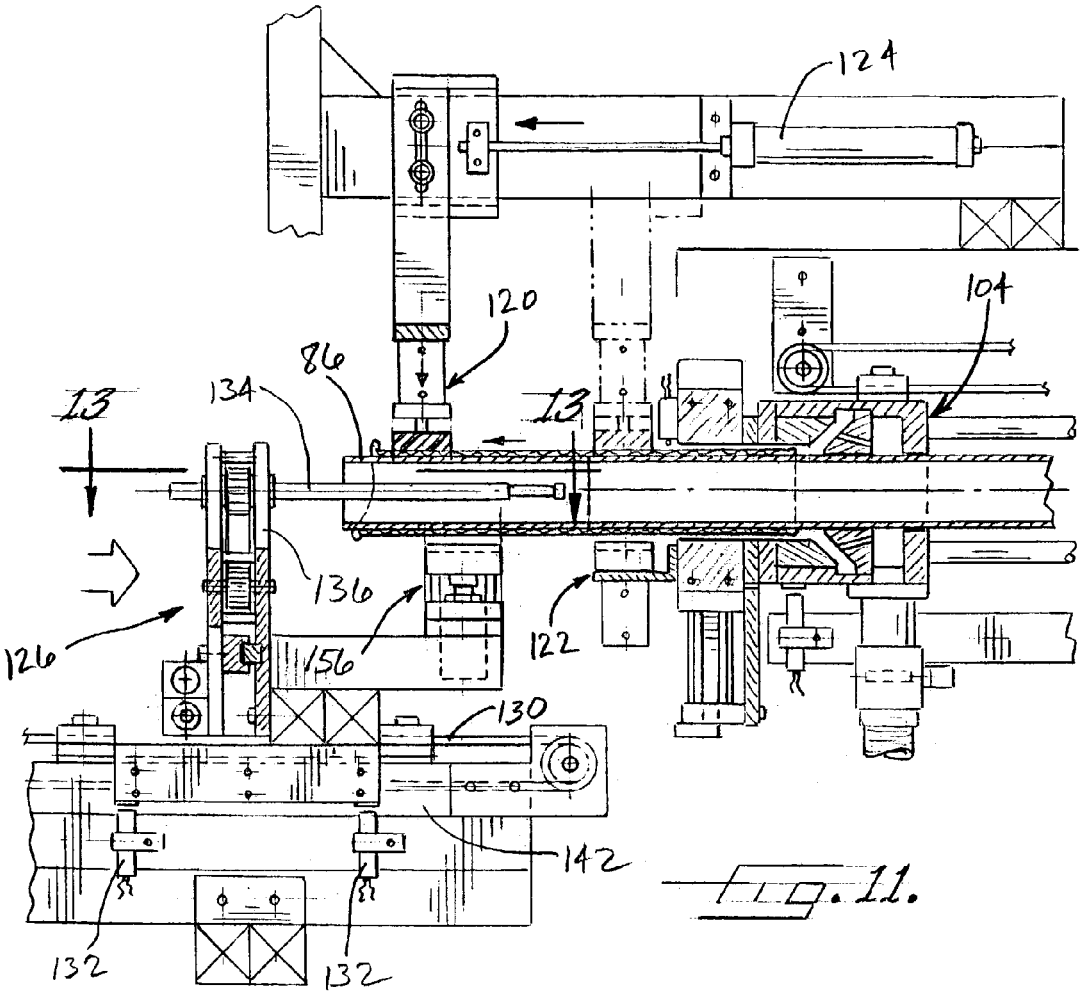
FIG. 11 represents a time subsequent to that of FIG. 10, when the support tube has been advanced forwardly to push through the open toe end of the sock blank so that the sock blank is fully inverted on the support tube, and showing a sock rotation device inserted into the open end of the support tube and sock blank thereon in preparation for removing the sock from the support tube.
Figure 12:
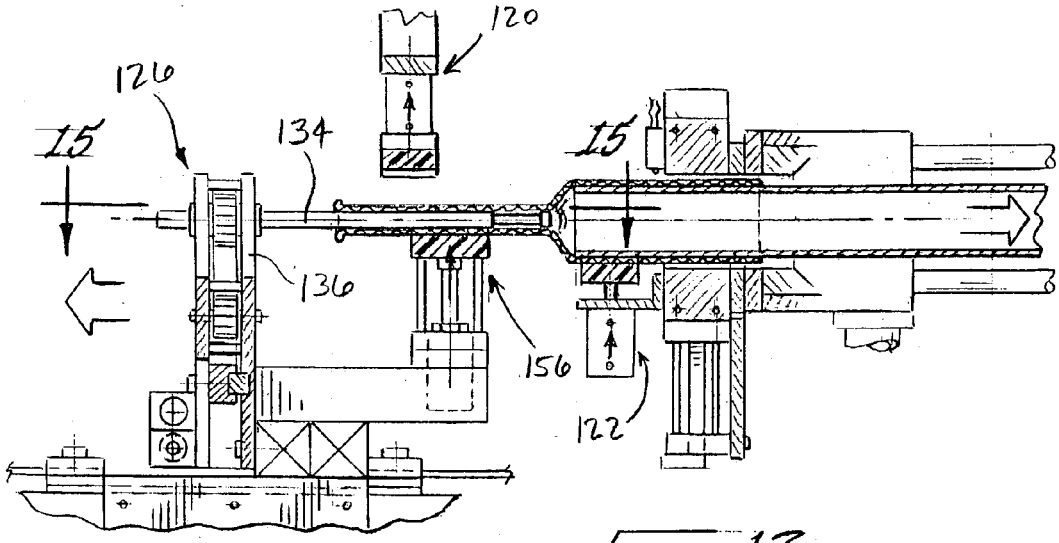
FIG. 12 shows the sock rotation device removing the sock blank from the support tube.

Once the sock is inverted over the outside of the support tube 86 as in FIG. 11, a sock rotation device 126 is axially advanced from a stand-by position (FIG. 5) into the position shown in FIG. 11. The sock rotation device 126 is axially aligned along the axis of the support tube 86 and is movable back and forth along the axis by a motor 128 and drive belt 130. Sensors 132 are used to detect when the sock rotation device 126 is in the proper axial position relative to the support tube 86 for taking the sock off the tube as explained below.

The sock rotation device 126 comprises a pair of rotatable rods 134 arranged parallel to each other and spaced apart in a transverse direction on opposite sides of the axis of the support tube 86. Each rod 126 is rotatably mounted at one end thereof in a rod support 136. The rod supports 136 are movable toward and away from each other in the transverse direction, so as to decrease or increase the spacing between the rods, as can be seen by comparing FIGS. 13 and 15, for example. Actuators 138, such as pneumatic cylinders, are used for moving the rod supports toward and away from each other; the rod supports 136 slide on guides mounted on a main support 140 for the sock rotation device. The main support 140 is slidably mounted on a guide rail 142 that extends axially so that the entire sock rotation device can be moved axially relative to the support tube 86.

The rods 134 of the sock rotation device are each attached to a pulley or sprocket 144 rotatably mounted in the respective rod support 136. A motor 146 having a drive sprocket 148 attached to its output shaft is mounted on the main support 140 adjacent a laterally outer side of one of the rod supports 136; an idler sprocket 150 is rotatably mounted on the main support on a laterally outer side of the other rod support 136. A drive belt 152 is looped about the drive sprocket 148, idler sprocket 150, and rod sprockets 144. Additional guide rollers 154 mounted on the rod supports 136 also are employed to guide the belt's path. Operation of the drive motor 146 causes the belt 152 to rotatably drive the rods 134 so that they are both rotated in the same rotational direction.

Figure 13:
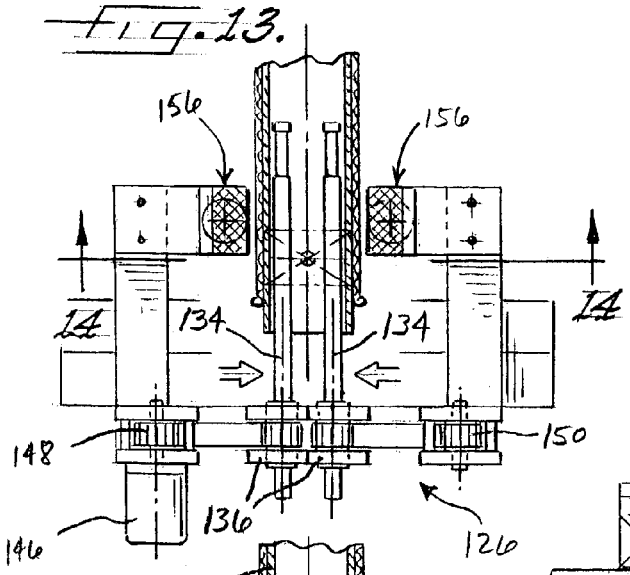
FIG. 13 is a view taken along line 13—13 in FIG. 1, showing the sock rotation device disposed in the support tube in preparation for removing the sock therefrom.
Figure 14:
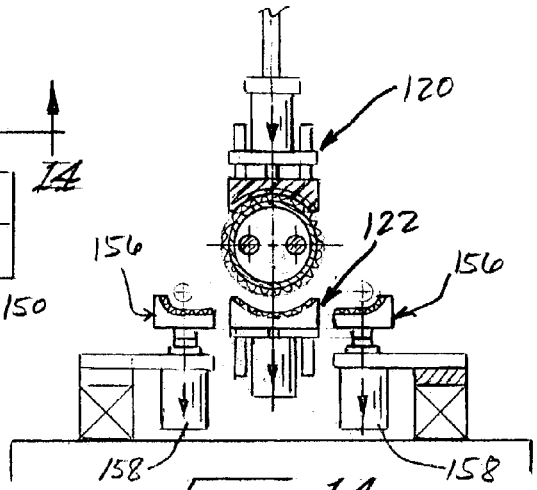
FIG. 14 is a view taken along line 14—14 in FIG. 13.
Figure 15:
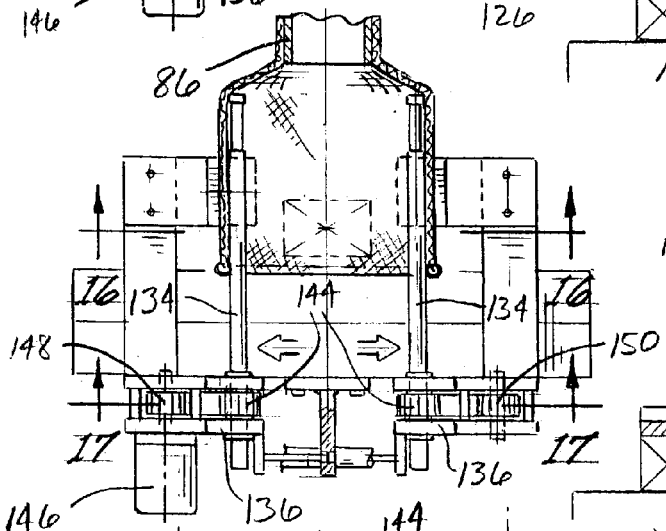
FIG. 15 is a view taken along line 15—15 in FIG. 12, showing the sock rotation device removing the sock from the support tube.
Figure 16:
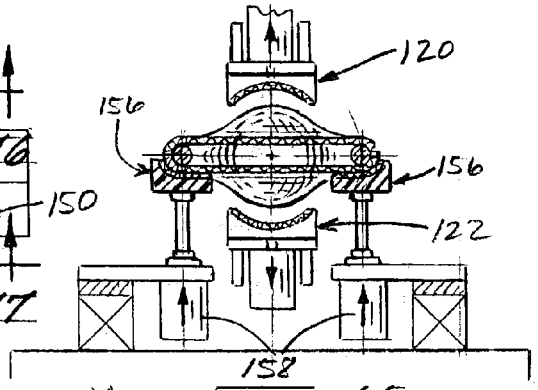
FIG. 16 is a view along line 16—16 in FIG. 15.
Figure 17:
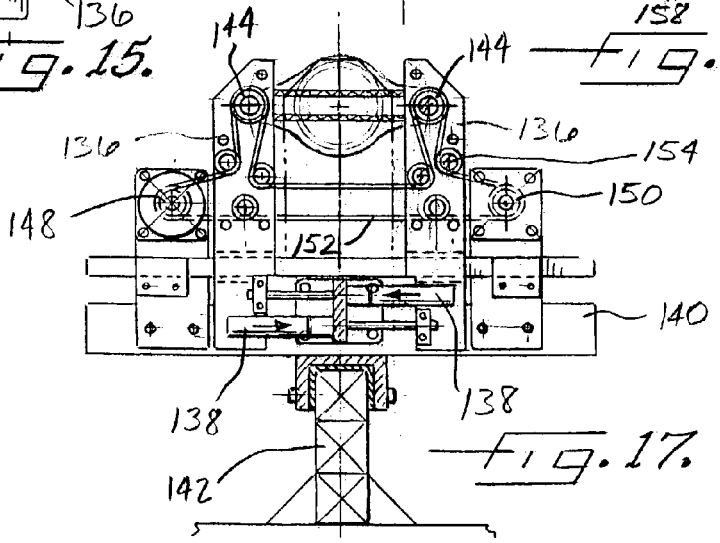
FIG. 17 is a view along line 17—17 in FIG. 15, showing details of the rotational drive mechanism for the sock rotation device.

When the rod supports 136 are moved inwardly toward each other to their fullest extent, the spacing between the rods 134 is such that the rods can be inserted into the open end of the support tube 86 as in FIG. 11 and FIG. 13. The sock rotation device 126 also includes a pair of sock clamps 156 mounted on the main support 140, one clamp 156 being mounted directly below each rod 134 when the rod is in its laterally outermost position as best seen in FIG. 16. The clamps 156 are vertically movable by pneumatic cylinders 158 or the like so as to clamp against the sock on the support tube 86 when the clamps are in their uppermost positions. In preparation for the sock rotation device removing the sock from the support tube 86, the clamps 156 are raised to clamp the sock, the upper clamp 120 and lower clamp 122 are disengaged from the sock, and the support tube 86 is retracted away from the sock rotation device to its intermediate position. Once the support tube clears the rods 134, the rods are moved apart as shown in FIGS. 15 and 16, which stretches the open toe end of the sock into a generally flattened condition and clamps the sock between the rods and the clamps 156.

Figure 18:
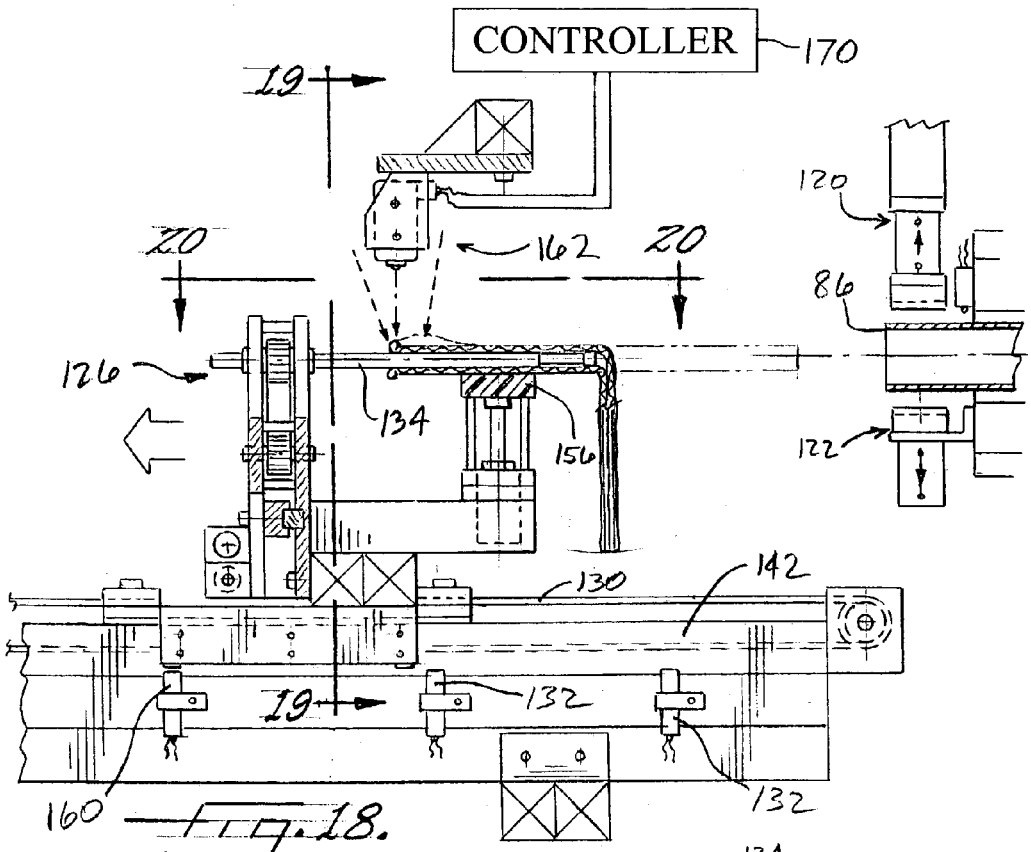
FIG. 18 shows the sock blank having been fully removed from the support tube and advanced into alignment with a sensor system of the apparatus.

Next, the sock rotation device 126 is retracted away from the support tube until the sock rotation device reaches an intermediate position along its path of travel, as detected by a proximity sensor 160 as shown in FIG. 18. As the sock rotation device travels toward the intermediate position, the clamps 156 are lowered to disengage the sock and the rods 134 are rotated so as to cause the sock to be rotated in a fashion similar to an endless belt looped about a pair of drive rolls. In the intermediate position of the sock rotation device, the sock has been fully removed from the support tube so that it is supported solely by the sock rotation device, and the open toe end of the rotating sock is proximate a sensor system 162 of the apparatus.

Figure 19:
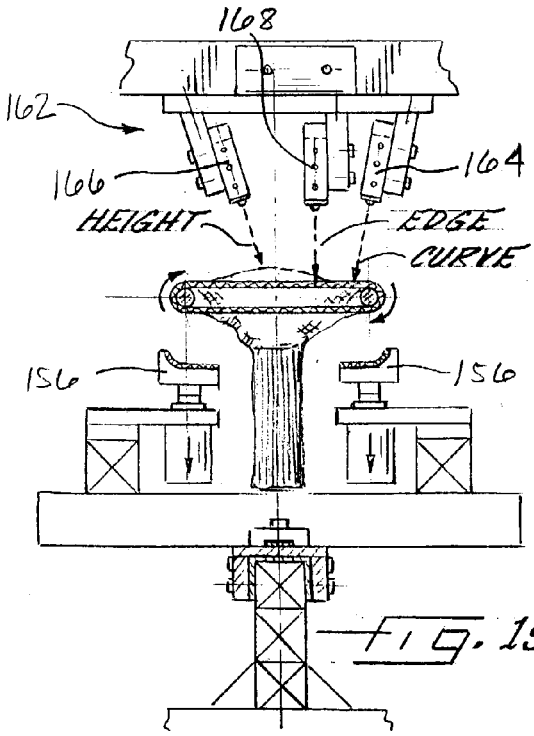
FIG. 19 is a view along line 19—19 in FIG. 18.
Figure 20A:
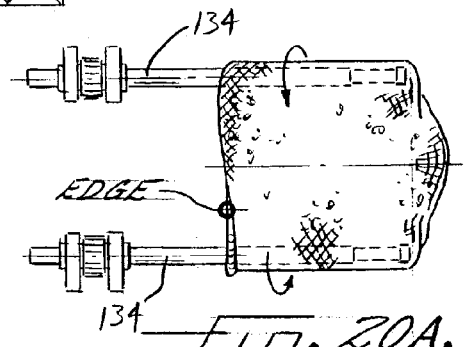
FIG. 20A is a view along line 20—20 in FIG. 18, showing the sock blank being rotated and being maintained in axial position to align the edge of the sock blank with an edge sensor of the sensor system.
Figure 20B:
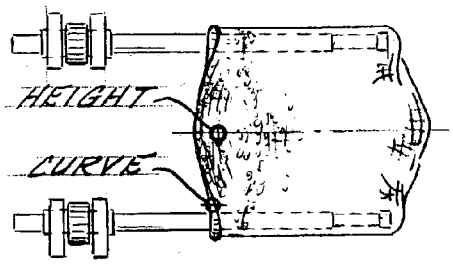
FIG. 20B is a view similar to FIG. 20A, showing the sock blank having been rotated and stopped in a rotational orientation in which the toe pocket of the sock blank is substantially centered between the rods of the sock rotation device, as detected by height and curve sensors for detecting the toe pocket position.

The sensor system 162 is described in connection with FIGS. 19 and 20. The system comprises a first sensor 164 for detecting when the curved edge of the axially protruding toe pocket of the rotating sock reaches a location with respect to the rods 134 such that the toe pocket is substantially centered between the two rods as shown in FIG. 20B. The first sensor 164 emits a beam of light and focuses the beam at a focal point that just misses the edge of the sock in the region outside the toe pocket but hits the curved edge at the beginning of the toe pocket as the sock is rotated. Some of the light striking the curved edge is reflected back to the sensor where it is detected, thus indicating that the curved edge is located at the focal point of the light beam.

The sensor system 162 preferably also includes a second sensor 166 for detecting an increased height of the sock, which indicates the bulkiness of the toe pocket, thus providing further assurance that the toe pocket is positioned on top between the rods 134.

A third sensor 168 preferably is also included for detecting the edge of the toe opening of the sock. The output signals from each of the sensors are received by a controller 170 coupled with the various drive motors of the apparatus, and the controller operates the drive motor 128 that axially positions the sock rotation device 126 so as to keep the edge of the sock axially aligned with the focused light beam spot created by the third sensor 168. In this manner, it is assured that the sock is in the correct axial location in order for the curved edge sensor 164 to properly detect the curved edge of the toe pocket as the sock is rotated. The three sensors 164, 166, 168 together can reliably detect when the toe pocket of the sock is on top of and centered between the rods 134, which assures that the sock is in the correct orientation for sewing closed the toe opening of the sock.

The sensors 164, 166, 168 can comprise any of various types of optical sensors such as laser sensors operating in the visible spectrum, infrared sensors, and the like. In the preferred embodiment, the edge sensor 168 comprises a visible laser sensor, and the sensors 164, 166 for detecting the toe pocket comprise infrared sensors.

Once the controller 170 determines based on the output signals from the sensors that the sock is oriented in the correct position for sewing, the rotation of the rods 134 is stopped. There may be a slight time lag between detecting the orientation of the sock and bringing the rods to a complete stop. In this case, preferably the sensors are suitably aimed and the controller is programmed so that the command to stop the rods is actually issued a short time before the sock reaches the correct orientation for sewing, such that the sock is in the correct orientation by the time the rods cease rotating.

The next step in the process is to remove the sock from the sock rotation device 126 in preparation for transferring it into a sewing machine. This operation is explained with reference to FIGS. 21–27, which depict a sock transfer device 172 of the apparatus. The sock transfer device 172 is mounted for back and forth movement in a transverse direction of the apparatus, between a position aligned with the central axis of the sock rotation device 126 (i.e., the axis along which the sock rotation device travels, which is coincident with the axis of the support tube 86), to a position spaced laterally from said central axis and toward a sewing machine, as best illustrated in FIG. 28.

Figure 24:
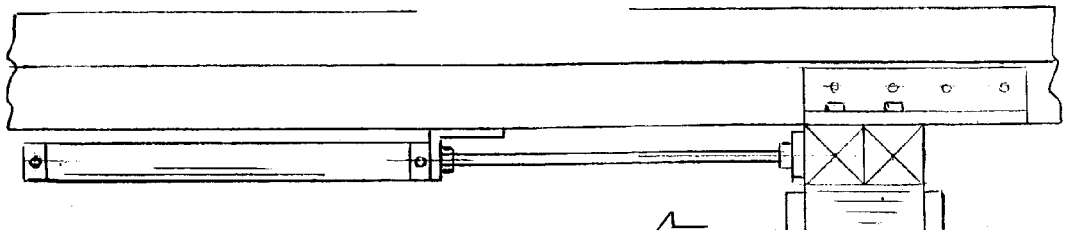
FIG. 24 is a view along line 24—24 in FIG. 21.

To remove a sock from the sock rotation device, the sock transfer device 172 is positioned in alignment with the central axis of the sock rotation device as shown in FIG. 24. The sock transfer device is spaced above the sock rotation device, and comprises a translating mechanism 174 that can be moved between a raised position in which it clears the sock rotation device, and a lowered position in which it engages the sock held on the sock rotation device. The translating mechanism 174 includes a support plate 176 that is mounted on a pair of guide rods 178. The guide rods are slidably mounted in a pair of guide apertures defined in a mounting block 180 that is slidably mounted on a rail 182 extending transversely toward the sewing machine as shown in FIG. 28. A pneumatic cylinder 184 or the like is mounted on the block 180 and has its rod connected to the support plate 176 so that extension of the rod causes the translating mechanism 174 to be lowered toward the sock rotation device, and retraction of the rod raises the translating mechanism up to clear the sock rotation device, as depicted respectively in solid and phantom lines in FIG. 21.

Figure 22:
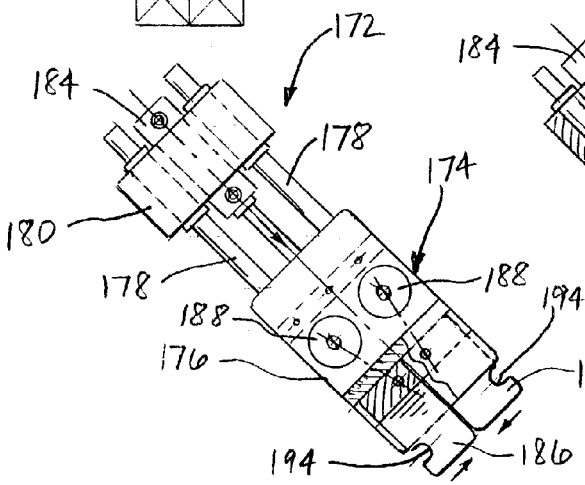
FIG. 22 is a view of the sock transfer device from below, along line 22—22 in FIG. 21, showing the fingers of the device in retracted positions.
Figure 23:
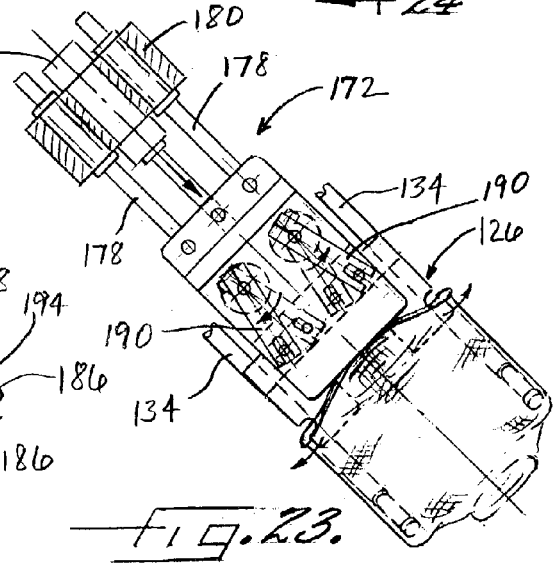
FIG. 23 is a view of the sock transfer device from above, along line 23—23 in FIG. 21, showing the fingers of the device spread apart to engage the sock blank on the sock rotation device.

The translating mechanism 174 includes a pair of fingers 186 slidably mounted in a guide affixed on an underside of the support plate 176. The fingers are disposed in side-by-side relation and can slide apart to increase the spacing between them (FIG. 23) and together to decrease the spacing between them (FIG. 22). The fingers 186 are moved by a pair of rotary actuators 188 connected respectively to a pair of arms 190 pivotally mounted on the upper surface of the support plate 176. The arms 190 have forked ends that engage pins 192 that are affixed to the fingers 186 and project up through slots formed in the support plate 176.

The support plate 176 is mounted so that it slopes downward toward the sock rotation device 126 at an angle relative to horizontal of about 45°. The fingers 186 have lower ends that project down below the lower end of the support plate 176, and these end portions of the fingers are formed as flat generally rectangular plates lying in a common plane parallel to the support plate 176. The laterally outer edge of each finger has a notch 194 for receiving one of the rods 134 of the sock rotation device when the fingers 186 are spread apart.

Figure 21:
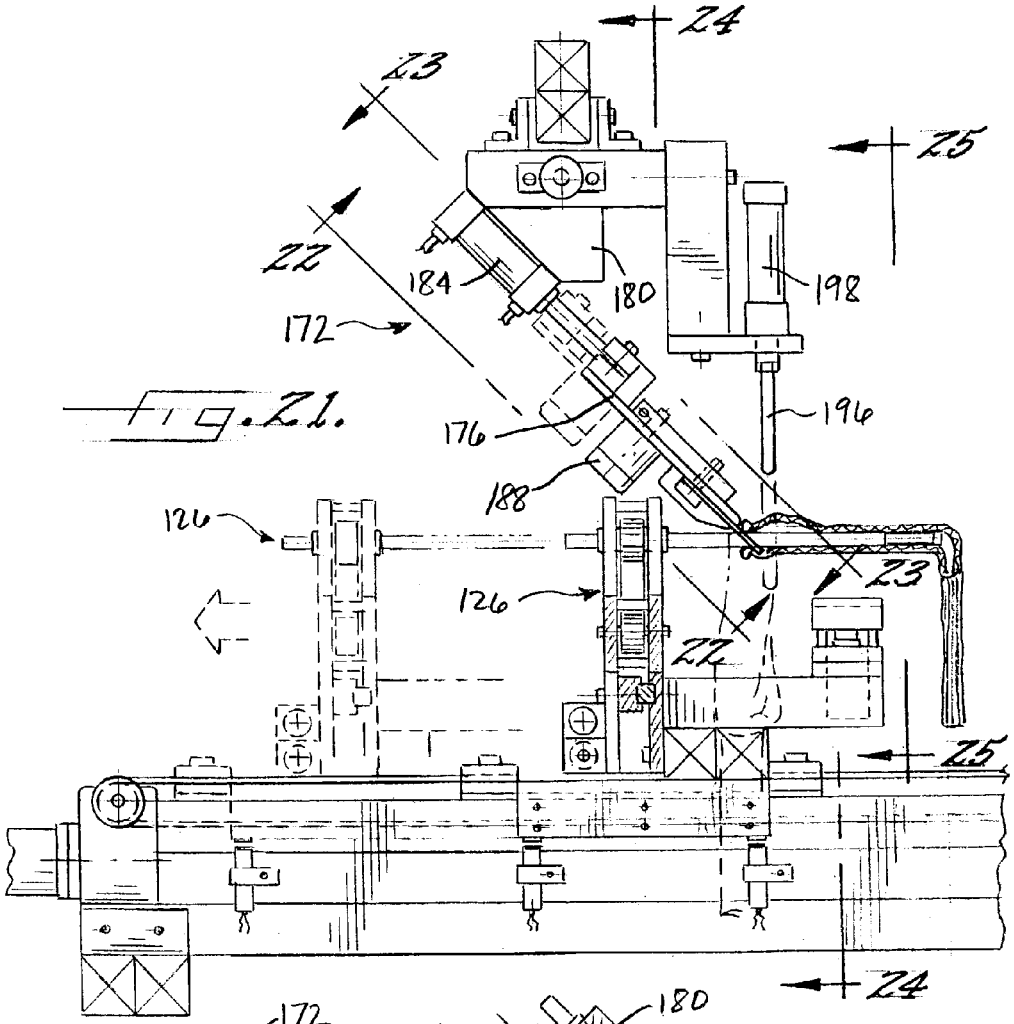
FIG. 21 an elevation showing the sock blank being engaged by a sock transfer device of the apparatus.
Figure 27A:
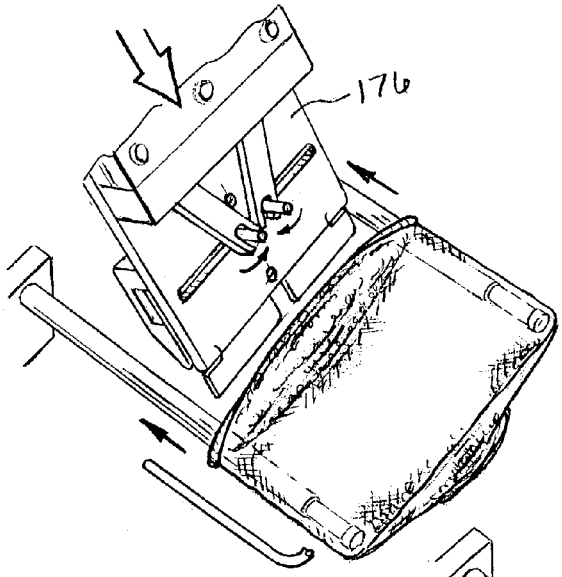
FIG. 27A is a perspective view of the sock transfer device moving into position to engage the sock blank on the sock rotation device.
Figure 27B:
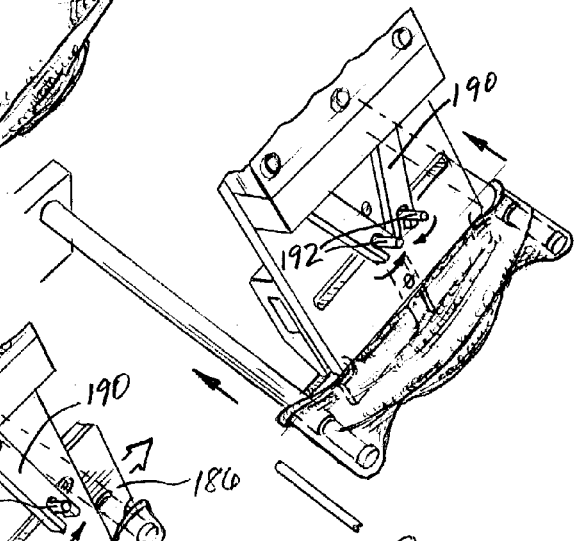
FIG. 27B shows the fingers of the sock transfer device engaged in the sock blank.
Figure 27C:
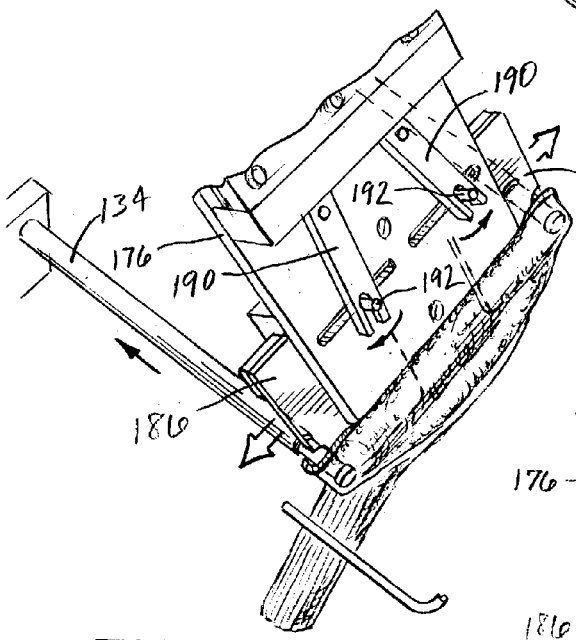
FIG. 27C shows the fingers spread apart to engage the sock blank, and the sock rotation device being retracted out from the sock blank.
Figure 27D:
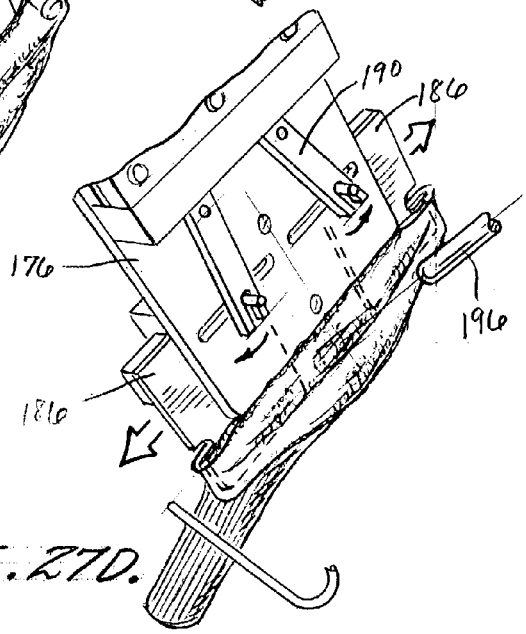
FIG. 27D shows the sock supported on the sock transfer device adjacent to a push rod of the apparatus.

To remove a sock from the sock rotation device, the rotary actuators 188 position the fingers 186 in their close spacing (FIG. 27A) and the cylinder 184 is extended to lower the support plate 176 down to its lowermost position. In this position, the ends of the fingers 186 extend into the open end of the sock on the sock rotation device, as illustrated in FIGS. 21 and 27B. The rotary actuators 188 are then actuated to spread the fingers 186 apart so as to engage the sock as shown in FIG. 27C; the rods 134 are received into the notches 194 in the fingers. The sock rotation device 126 is then retracted away from the sock transfer device to a position indicated in phantom lines in FIG. 21, thereby withdrawing the rods 134 from the sock so that the sock is held only by the fingers 186 of the sock transfer device as shown in FIG. 27D. The end of each of the rods 134 preferably has a reduced-diameter portion extending from a point just inward from the free end of the rod toward the opposite end of the rod for some distance, thereby forming a lip at the free end of the rod; this lip helps move the sock into secure engagement with the respective finger 186 as the rod is withdrawn from the sock.

Figure 25:
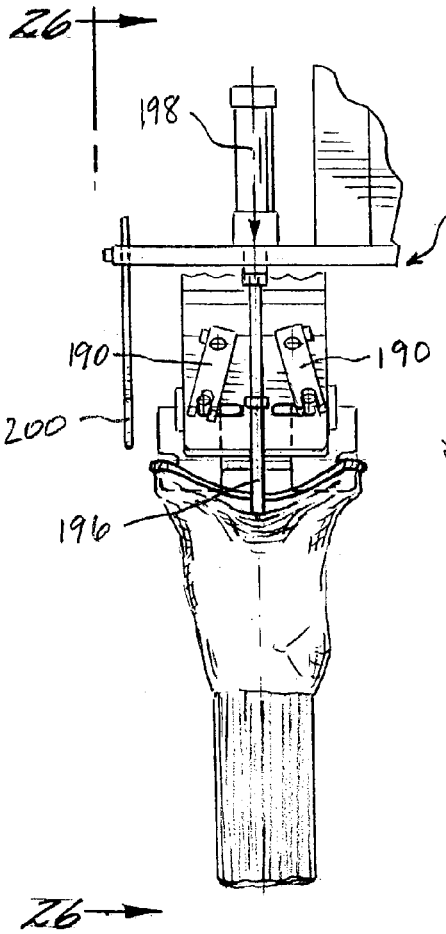
FIG. 25 is a view along line 25—25 in FIG. 21, after the sock blank has been fully removed from the sock rotation device.
Figure 26:
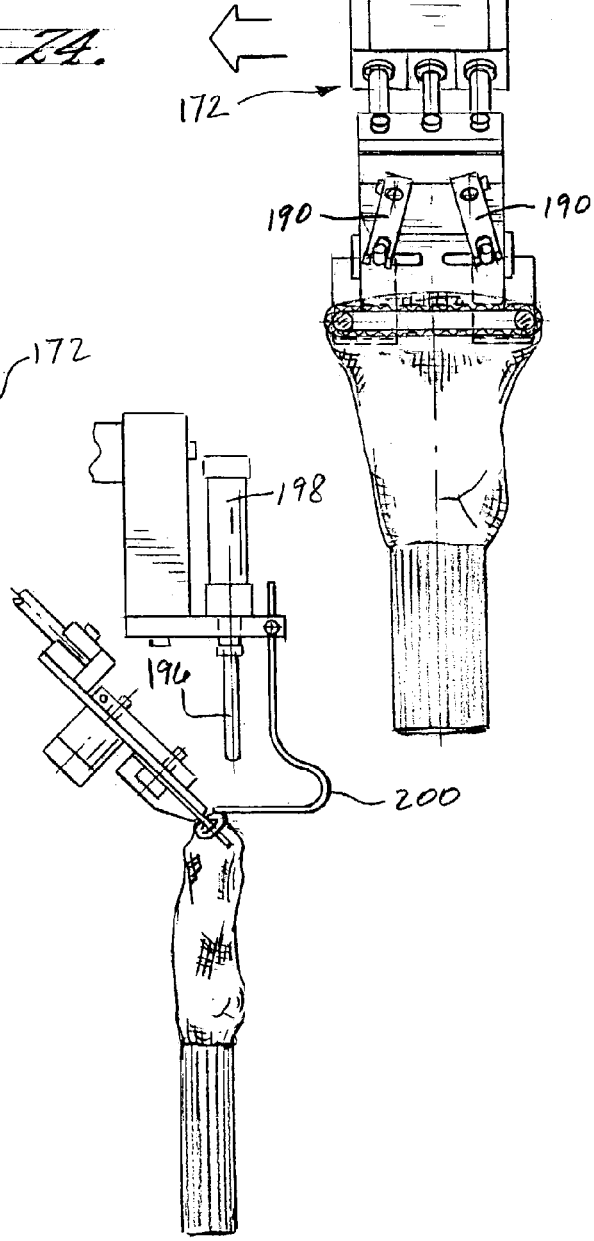
FIG. 26 is a view along line 26—26 in FIG. 25.
Figure 27E:
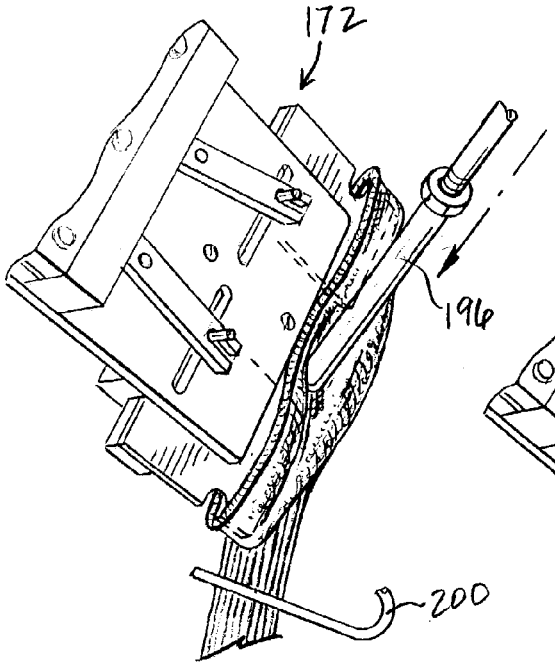
FIG. 27E shows the push rod extended to push down the toe pocket of the sock on the sock transfer device so that the sock lies better for transfer into a sewing machine.
Figure 27F:
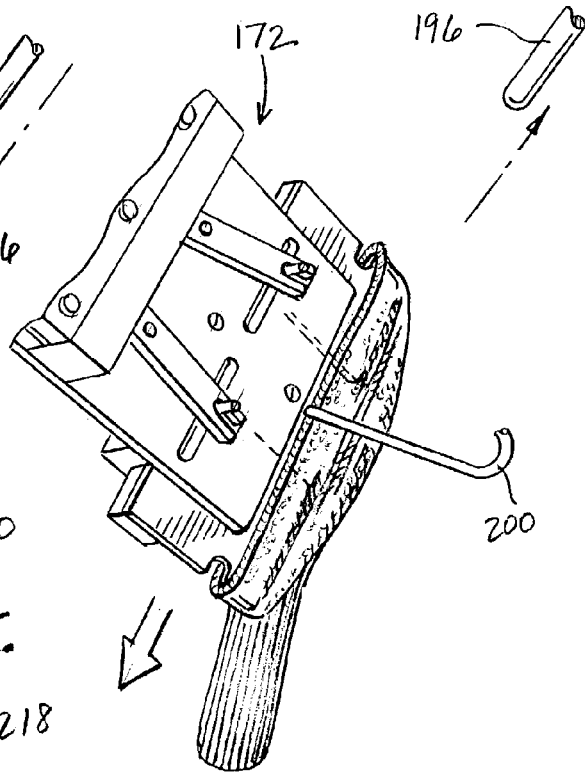
FIG. 27F shows the sock transfer device being translated toward a sewing machine.

Next, a push rod 196 mounted for vertical movement above the sock is lowered by a suitable pneumatic cylinder 198 or the like such that the lower end of the push rod pushes the toe pocket of the sock down as shown in FIGS. 25 and 27E, and the push rod is retracted back up. This helps straighten the edge of the toe opening and puts the sock in a better configuration for feeding into the in-feed nip of the sewing machine. The sock transfer device 172 then is advanced transversely toward the sewing machine. As the sock transfer device advances toward the sewing machine, the sock is carried beneath a stationary plow 200 mounted to a fixed frame of the apparatus above the sock, and a lower end of the plow engages the upper portion of the sock at the toe opening so as to further straighten and flatten the sock.

Figure 29:
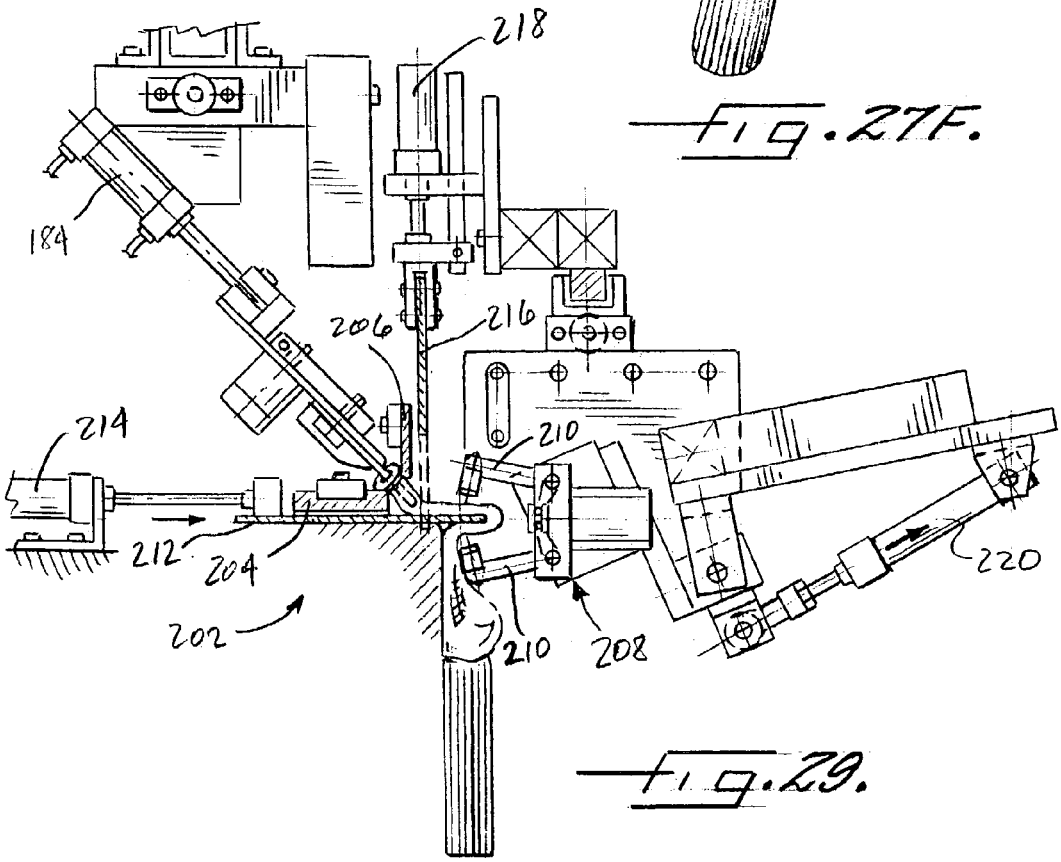
FIG. 29 is a side view along line 29—29 in FIG. 28, showing the sock having been carried into a sock guiding arrangement in preparation for being fed into an in-feed nip of the sewing machine.
Figure 22B:
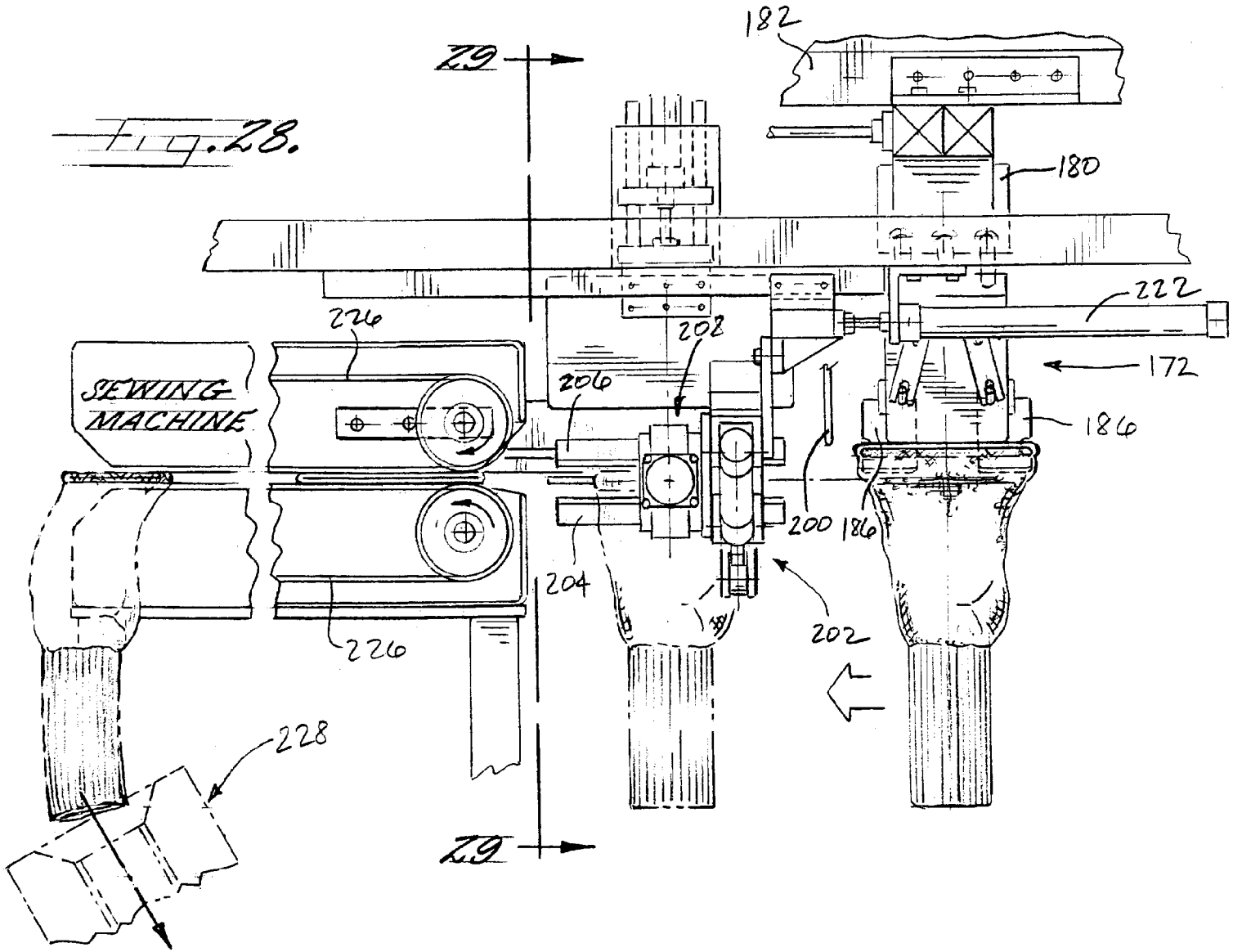
Figure 30A:
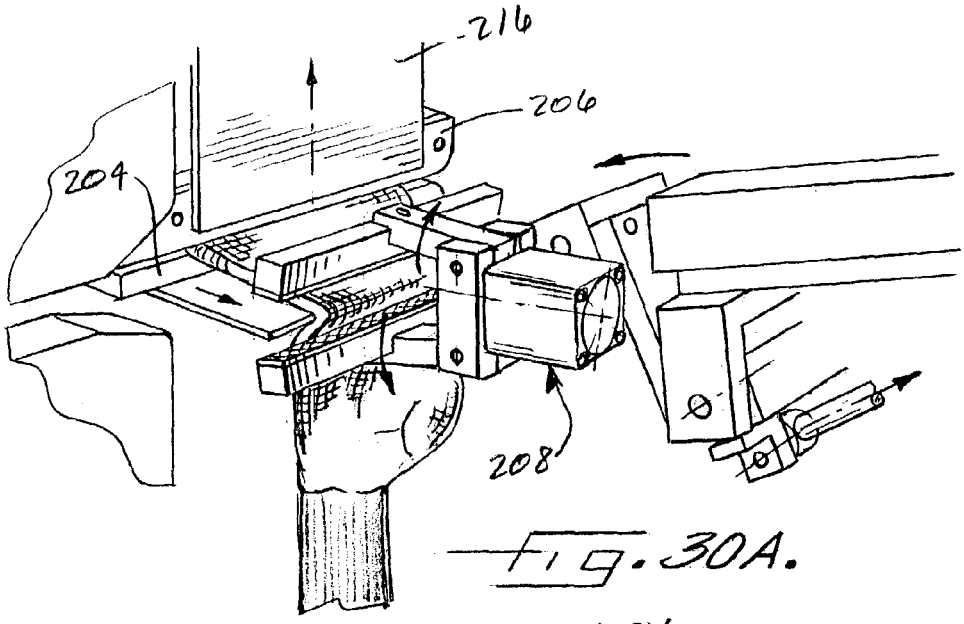
FIG. 30A is a perspective view of the sock guiding arrangement at a first instant in time.
Figure 30B:
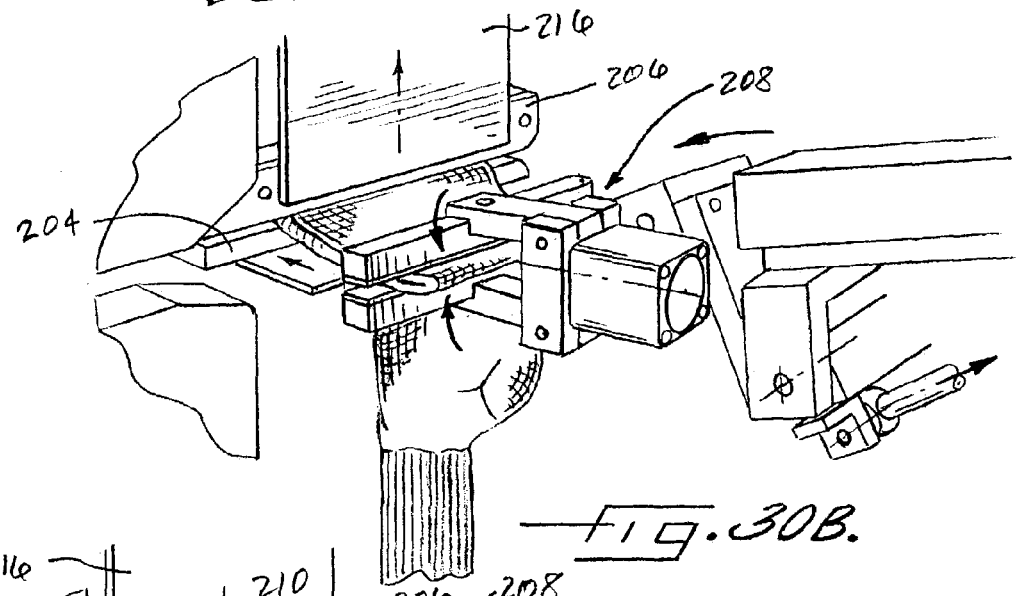
FIG. 30B shows the sock guiding arrangement at a later instant in time.

The sock transfer device 172 carries the sock into a sock guiding device 202 whose structure and operation are now explained with reference to FIGS. 28–30. The sock guiding device 202 includes a pair of stationary guide members 204, 206 that cooperatively form a guide channel between them through which the flattened toe end of the sock is fed in preparation for feeding it into the in-feed nip of the sewing machine. The guide member 204 comprises a plate or block mounted generally horizontally and the guide member 206 comprises a plate mounted generally vertically such that the lower edge of the plate is vertically spaced a distance above the upper surface of the guide 204 and horizontally spaced away from the free end of the guide 204 so as to form a channel therebetween as best seen in FIG. 29. The guides 204, 206 are located just upstream of and in alignment with the in-feed nip of the sewing machine as depicted in FIG. 30F. The toe end of the sock is passed through the channel defined by the guides 204, 206 and then into the in-feed nip.

However, while the sock is positioned between the guides 204, 206 the sock is operated upon in order to optimize the position of the sock for sewing. In particular, when the toe end of the sock is fed into the channel between the guides 204, 206, there may be a greater amount of sock material projecting upward from the channel than is desirable; if the sock were fed into the sewing machine in this condition, the sewn seam across the toe end would not be as close to the edge of the sock as desired, which would leave too much excess material at the seam. To address this potential problem, the apparatus includes a clamp device 208 mounted proximate a back side of the channel from which the main portion of the sock hangs down. The clamp device includes a pair of clamping arms 210 that are pivotally movable toward and away from each other in a scissor fashion to form a pincers for grasping the sock protruding from the channel of the guides 204, 206. The clamp device also includes a horizontal pusher plate 212 mounted for horizontal sliding movement just below the guide 204. The horizontal pusher plate 212 is moved by a pneumatic cylinder 214 or the like so as to extend into the space between the clamp arms 210 of the clamp device when the arms are apart as shown in FIG. 29. The pusher plate 212 thereby pushes the sock between the clamp arms of the clamp device 208. While the pusher plate 212 is positioned between the clamp arms 210 of the clamp device, the clamp device is closed on the sock to hold it and the pusher plate is retracted as shown in FIG. 30B.

Figure 30C:
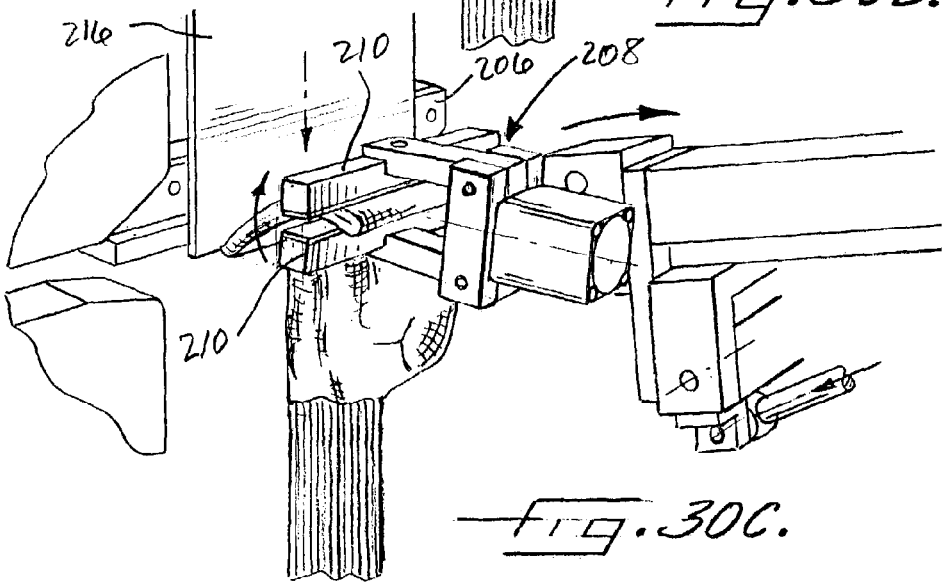
FIG. 30C shows the sock guiding arrangement at a still later instant in time.

Next, a vertical pusher plate 216 mounted for vertical movement between the guide 206 and the clamp device 208 is moved by a pneumatic cylinder 218 or the like so that the plate 216 pushes the sock down as shown in FIG. 30C. At the same time, the clamp device 208, which is mounted for pivotal movement about a horizontal transverse axis, is pivoted upward by a pneumatic cylinder 220 or the like, which pulls the sock upward relative to the pusher plate 216. The combined action of the pusher plate 216 pushing down and the clamp device 208 pulling up causes the enlarged clip knitted into the edge of the sock's toe opening to be drawn tight against the guide members 204, 206; the spacing between the guide members is set such that the clip is not pulled through the channel when the sock is manipulated in this manner. The sock is now ready to be fed into the in-feed nip of the sewing machine.

Figure 30D:
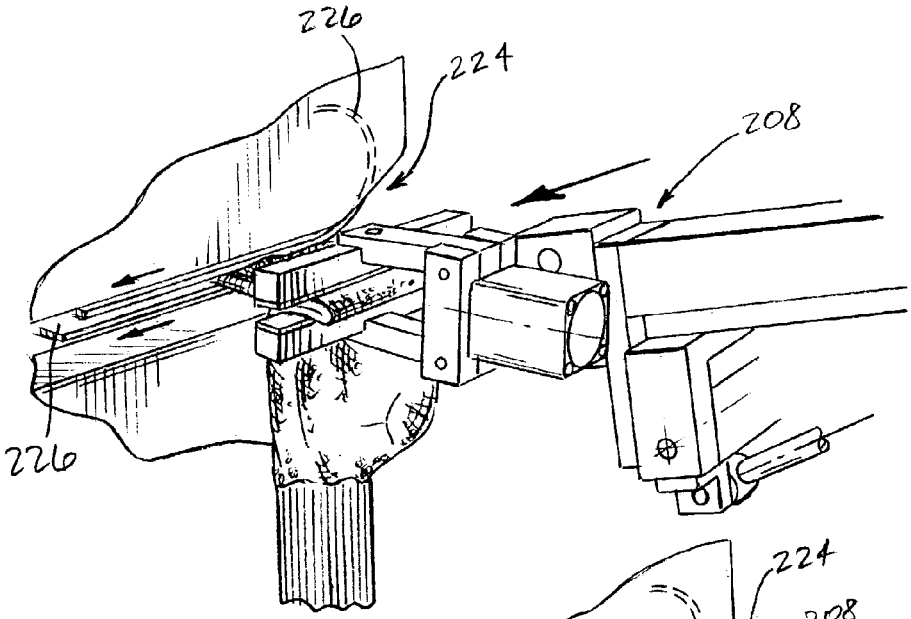
FIG. 30D shows the sock guiding arrangement leading the sock into the in-feed nip of the sewing machine.
Figure 30E:
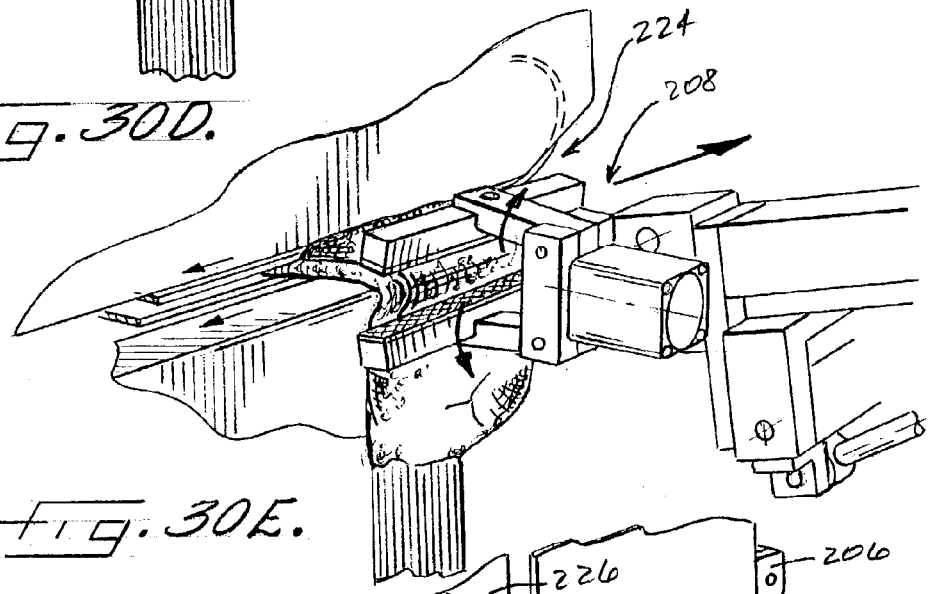
FIG. 30E shows the sock guiding arrangement releasing the sock once it is engaged in the in-feed nip of the sewing machine.
Figure 30F:
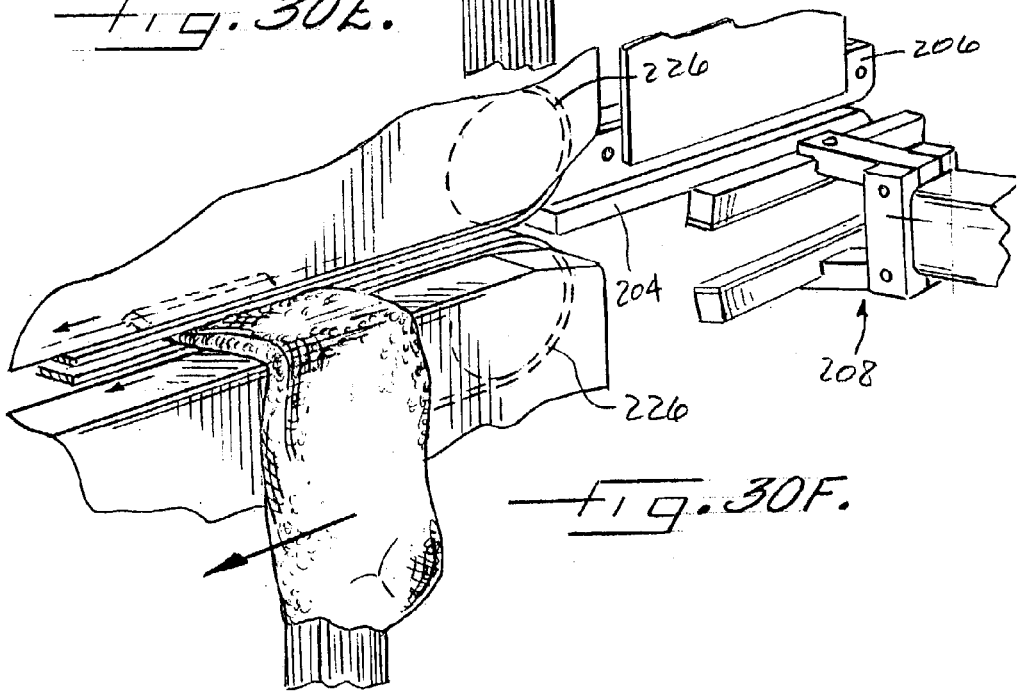
FIG. 30F shows the in-feed nip carrying the sock into the sewing machine.

To this end, as shown in FIG. 28, the entire clamp device 208 is mounted for transverse movement toward and away from the in-feed nip. While the clamp device 208 is holding onto the sock, the clamp device is moved by a pneumatic cylinder 222 or the like toward the in-feed nip of the sewing machine. For illustrative purposes, an in-feed nip 224 is shown in FIGS. 30D–F as consisting of a pair of oppositely rotating endless belts 226 looped about suitable pulleys or rollers such that the belts are closely spaced apart. The sock is fed by the clamp device 208 into the space between the belts, which grip the sock and carry it into the sewing machine. Once the belts have grabbed the sock, the clamp device 208 lets go of the sock and is moved back to its starting position in preparation for the next sock. The sewing machine sews the open toe end of the sock closed and then discharges the sock. If desired, the sewing machine can discharge the sock, which is turned inside out, into a device 228 for turning the sock right-side out. The device 228 can comprise a tube and vacuum clamp arrangement similar to that already described for inverting the sock.

While the in-feed nip in the illustrated embodiment is set up to guide the sock into the sewing machine in a horizontal orientation, it should be noted that the apparatus can also work with a sewing machine having a vertical in-feed nip, by virtue of the 45° inclination of the sock transfer device 172 and the corresponding 45° arrangement of the guide members 204, 206.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. An apparatus for orienting and positioning an open toe end of a tubular sock blank so that the toe end can be closed in an automatic sewing machine, the apparatus comprising:

a tube for supporting the sock blank sleeved thereover such that the sock blank extends lengthwise along a longitudinal axis of the tube with the toe end opened up into a generally tubular shape and positioned adjacent an open end of the tube; and a sock rotation device structured and arranged to move into the open toe end of the sock, grasp the sock and remove the sock from the tube such that the sock is supported on the sock rotation device, and for rotation of the sock about an axis thereof while inserted in the sock for orienting the sock prior to transfer of the sock into a sewing machine.

2. The apparatus of claim 1, wherein the sock rotation device is structured and arranged to spread the open toe end of the sock into a generally flattened condition and to rotate the sock in said generally flattened condition.

3. The apparatus of claim 2, wherein the toe end defines a toe opening encircled by an edge of the blank made up of first and second edge portions that are joined at junctures located on generally diametrically opposite sides of the toe opening, the first edge portion delimiting an extended toe pocket of the sock blank extending axially beyond the second edge portion when the sock blank is opened up into a generally tubular shape, and further comprising a sensor system including at least a first optical sensor emitting a light beam aimed to detect a feature of the toe end of the sock when the sock is rotated by the sock rotation device so as to bring said feature into alignment with said light beam of the first sensor, whereby a rotational orientation of the sock is determined based at least in part on an output signal from the first sensor.

4. The apparatus of claim 3, wherein the first sensor's light beam is aimed to detect the first edge portion of the sock when the sock rotation device rotates the sock into a predetermined rotational orientation.

5. The apparatus of claim 4, wherein the sensor system includes a second optical sensor emitting a light beam aimed to detect another feature of the toe end of the sock when the sock is rotated into said predetermined rotational orientation.

6. The apparatus of claim 5, wherein the second sensor is operable to detect the toe pocket of the sock by detecting an increased height of the toe pocket relative to the remainder of the sock.

7. The apparatus of claim 6, wherein the sock rotation device is further operable to translate the sock generally parallel to the axis about which the sock is rotated in order to maintain axial alignment of the sock with the light beams of the sensors.

8. The apparatus of claim 7, wherein the sensor system further comprises a third optical sensor emitting a light beam aimed to detect the edge of the toe opening when the sock is in a predetermined axial position suitable for proper detection of the first edge portion and toe pocket by the first and second sensors.

9. The apparatus of claim 8, further comprising an axial actuator operable to effect axial movement of the sock rotation device and a rotational actuator operable to cause the sock rotation device to rotate the sock, and a controller in communication with said actuators and with the optical sensors, the controller being operable to control the axial actuator so as to axially move the sock rotation device to keep the sock in the predetermined axial position, and to control the rotational actuator to stop the rotation of the sock upon detection of signals from the first and second sensors indicating that the sock is in the predetermined rotational orientation.

10. The apparatus of claim 9, wherein the sock rotation device comprises a pair of rotatably driven rods arranged in parallel and movable between a relatively close spacing and a relatively wide spacing from each other, the sock rotation device being operable to axially advance the rods at the close spacing into the open toe end of the sock on the tube, to spread the rods apart to the wide spacing to grasp the sock, and to axially retract the rods so as to remove the sock from the tube.

11. The apparatus of claim 10, further comprising a sock transfer device operable to grasp the sock once the sock has been oriented in the predetermined rotational orientation on the sock rotation device, and to remove the sock from the sock rotation device and transfer the sock into a sewing machine.

12. The apparatus of claim 1, wherein the sock rotation device comprises a pair of rotatably driven rods arranged in parallel and movable between a relatively close spacing and a relatively wide spacing from each other, the sock rotation device being operable to axially advance the rods at the close spacing into the open toe end of the sock on the tube, to spread the rods apart to the wide spacing to grasp the sock, and to axially retract the rods so as to remove the sock from the tube, the rods being rotated to rotate the sock.

13. The apparatus of claim 12, further comprising a sock transfer device operable to grasp the sock once the sock has been oriented in a predetermined rotational orientation on the sock rotation device, and to remove the sock from the sock rotation device and transfer the sock into a sewing machine.

14. The apparatus of claim 13, wherein the sock transfer device comprises a pair of spreader fingers arranged substantially in a plane inclined about 45° relative to horizontal, the sock transfer device being operable to spread the spreader fingers apart to grasp the sock and maintain the toe end of the sock in a substantially flattened condition, and to transfer the sock toward an in-feed nip of a sewing machine while maintaining the spreader fingers inclined about 45° from horizontal, whereby the sock can be fed into either a vertically arranged in-feed nip or a horizontally arranged in-feed nip.

15. A sock rotational device for rotatably orienting a sock blank, comprising:

a pair of generally cylindrical rods arranged in parallel spaced relation to each other, each rod being rotatably supported at one end thereof by a rod support and extending away from the rod support in an axial direction and terminating at a free end, the rod supports being movable toward and away from each other in a transverse direction for varying the spacing between the rods, wherein the rods comprise axially extending grooves in the outer surfaces of the rods for preventing rotational slip of the sock relative to the rods;

an actuation system for moving the rod supports apart to cause the rods to spread a toe end of a sock into a generally flattened orientation; and a drive arrangement structured and arranged to rotatably drive the rods about their axes in the same rotational direction so as to rotate the sock about an axis.

16. The sock rotation device of claim 15, wherein each rod defines a gripping feature at the free end of the rod for preventing the toe end of the sock from slipping axially off the free end.

17. The sock rotation device of claim 16, wherein the gripping feature comprises a radially outwardly projecting lip.

18. The sock rotation device of claim 17, wherein the lip is formed at an end portion of each rod having a reduced diameter relative to the remainder of the rod.

19. An apparatus for rotationally orienting a tubular sock blank so that an open toe end of the sock blank can be closed in an automatic sewing machine, the toe end having an extended toe pocket extending along approximately half of a circumference of the open toe end, the toe pocket protruding axially beyond the remainder of the toe end, the apparatus comprising:

a sock rotation device operable to extend into a sock to spread the open toe end of the sock into a generally flattened condition and to rotate the flattened toe end about an axis while inserted in the sock such that and edge of the sock that circumscribes an opening at the open toe end forms a generally flattened loop that rotates about said axis; and a sensor system including at least a first optical sensor emitting a light beam aimed to detect a feature of the toe end of the sock when the sock is rotated by the sock rotation device so as to bring said feature into alignment with said light beam of the first sensor, whereby a rotational orientation of the sock is determined based at least in part on an output signal from the first sensor.

20. The apparatus of claim 19, wherein the first sensor's light beam is aimed to detect an edge of the axially protruding toe pocket of the sock when the sock rotation device rotates the sock into a predetermined rotational orientation.

21. The apparatus of claim 20, wherein the sensor system includes a second optical sensor emitting a light beam aimed to detect another feature of the toe end of the sock when the sock is rotated into said predetermined rotational orientation.

22. The apparatus of claim 21, wherein the second sensor is operable to detect the toe pocket of the sock by detecting an increased height of the toe pocket relative to the remainder of the sock.

23. The apparatus of claim 21, wherein the sock rotation device is further operable to translate the sock generally parallel to the axis about which the sock is rotated in order to maintain axial alignment of the sock with the light beams of the sensors.

24. The apparatus of claim 21, wherein the sensor system further comprises a third optical sensor emitting a light beam aimed to detect the edge of the toe opening when the sock is in a predetermined axial position suitable for proper detection of the toe pocket by the first and second sensors.

25. The apparatus of claim 24, further comprising an axial actuator operable to effect axial movement of the sock rotation device and a rotational actuator operable to cause the sock rotation device to rotate the sock, and a controller in communication with said actuators and with the optical sensors, the controller being operable to control the axial actuator so as to axially move the sock rotation device to keep the sock in the predetermined axial position, and to control the rotational actuator to stop the rotation of the sock upon detection of signals from the first and second sensors indicating that the sock is in the predetermined rotational orientation.

* * * * *

UNITED STATES PATENT AND TRADEMARK OFFICE

CERTIFICATE OF CORRECTION

PATENT NO. : 7,025,011 B2
APPLICATION NO. : 10/351747
DATED : April 11, 2006
INVENTOR(S) : Jordan et al.

It is certified that error appears in the above-identified patent and that said Letters Patent is hereby corrected as shown below:

Column 1,
Line 37, "yams" should read --yarns--.

Column 2,
Line 14, "discemable" should read --discernable--.

Signed and Sealed this

Twenty-ninth Day of August, 2006

JON W. DUDAS
*Director of the United States Patent and Trademark Office*